US010647025B2

(12) United States Patent
Fox et al.

(10) Patent No.: US 10,647,025 B2
(45) Date of Patent: May 12, 2020

(54) MOBILE MIXING DEVICES, SYSTEMS AND RELATED METHODS

(71) Applicant: REEVES ENTERPRISES, INC., Albany, NY (US)

(72) Inventors: Steve A. Fox, South Promfret, VT (US); Mark C. Reeves, Slingerlands, NY (US); Edward F. Reeves, Glenmont, NY (US)

(73) Assignee: Reeves Enterprises, Inc., Albany, NY (US)

( * ) Notice: Subject to any disclaimer, the term of this patent is extended or adjusted under 35 U.S.C. 154(b) by 174 days.

(21) Appl. No.: 15/512,184

(22) PCT Filed: Sep. 18, 2015

(86) PCT No.: PCT/US2015/050962
§ 371 (c)(1),
(2) Date: Mar. 17, 2017

(87) PCT Pub. No.: WO2016/044738
PCT Pub. Date: Mar. 24, 2016

(65) Prior Publication Data

US 2017/0246764 A1 Aug. 31, 2017

Related U.S. Application Data

(60) Provisional application No. 62/052,037, filed on Sep. 18, 2014.

(51) Int. Cl.
*B28C 5/20* (2006.01)
*E01C 19/45* (2006.01)
(Continued)

(52) U.S. Cl.
CPC ..... *B28C 5/2054* (2013.01); *B01F 9/06* (2013.01); *B01F 15/065* (2013.01);
(Continued)

(58) Field of Classification Search
CPC ..... E01C 19/45; B28C 5/20; B28C 5/1806; B28C 1/1831; B28C 5/1831
(Continued)

(56) References Cited

U.S. PATENT DOCUMENTS 792,642 A * 6/1905 Williams ..... C21B 9/12 266/141
924,132 A * 6/1909 Blake ..... E01C 19/1036 193/10

(Continued)

OTHER PUBLICATIONS

Skid Patcher—10A Asphalt Plant & Recycler, online by Aug. 19, 2013.*

(Continued)

*Primary Examiner* — David L Sorkin
(74) *Attorney, Agent, or Firm* — J. Bennett Mullinax, LLC

(57) ABSTRACT

Mobile mixing devices, mobile mixing systems, and related methods are provided. A mobile mixing device can include a frame and a mixing drum securable to the frame. The mixing drum can include a body that forms an internal cavity and can have a forward end and a bottom end. The mixing drum can also include a mouth at the forward end of the body that provides access to the internal cavity of the mixing drum. The mobile mixing device can include a heater support arm having a heater secured to an end of the heater support arm that is distal from the mixing drum. The mixing drum can be used to process cement material when the heater support arm is in a stow-away position or asphalt when the heater support arm is in a heating position with the heater facing into the mouth of the mixing drum.

12 Claims, 15 Drawing Sheets

(51) Int. Cl.

| | |
|---|---|
| ***B01F 9/06*** | (2006.01) |
| ***B01F 15/06*** | (2006.01) |
| ***B28C 5/18*** | (2006.01) |
| ***B28C 5/08*** | (2006.01) |
| ***E01C 19/10*** | (2006.01) |
| ***B28C 7/12*** | (2006.01) |
| ***E01C 19/08*** | (2006.01) |

(52) U.S. Cl.
CPC ..... *B28C 5/0812* (2013.01); *B28C 5/0825* (2013.01); *B28C 5/0856* (2013.01); *B28C 5/0893* (2013.01); *B28C 5/1831* (2013.01); *B28C 5/1837* (2013.01); *B28C 5/1862* (2013.01); *B28C 7/12* (2013.01); *B28C 7/126* (2013.01); *E01C 19/08* (2013.01); *E01C 19/10* (2013.01); *E01C 19/45* (2013.01); *B01F 2015/062* (2013.01); *B01F 2215/0047* (2013.01); *B01F 2215/0063* (2013.01)

(58) Field of Classification Search
USPC ..... 366/25
See application file for complete search history.

(56) References Cited

U.S. PATENT DOCUMENTS

| | | | | |
|---|---|---|---|---|
| 1,205,948 | A * | 11/1916 | Popkess | E01C 19/1054 366/153.3 |
| 1,420,757 | A * | 6/1922 | Ryan | E01C 19/1027 366/25 |
| 1,578,021 | A * | 3/1926 | Elze | B28C 5/466 366/25 |
| 4,208,131 | A | 6/1980 | Mendenhall | |
| 4,240,754 | A | 12/1980 | Mendenhall | |
| 5,538,340 | A | 7/1996 | Brashears | |
| 5,667,298 | A | 9/1997 | Musil et al. | |
| 2012/0205400 | A1 | 8/2012 | DeGaray | |
| 2013/0238255 | A1 | 9/2013 | Cooley et al. | |

OTHER PUBLICATIONS

International Search Report and Written Opinion for International Application No. PCT/US2015/050962 dated Jan. 26, 2016.

(Stoikes, J)—"Get Attached to Paving and Patching", http://www.forconstructionpros.com/article/11576957/skid-steer-attachments-deliver-paving-andpatching-productivity; Aug. 14, 2014, pp. 1-6.

(Pavement Technologies International Corp.) "Skid Patcher—10A Asphalt Plant & Recycler," http://www.forconstructionpros.com/product/10736732/pavementgroup-corp-bagholmix: Aug. 19, 2013, pp. 1-2.

(KM International) "KM International T2 Asphalt Millings Recycler," YouTube video, https://www.youtube.com/watch?v=M0nfpKxdlCo, Feb. 1, 2011.

(Bagela) Asphalt Recyclers Product Webpage for the manufacturer Bagela Baumaschinen GmbH & Co. KG, http://bagela.de/en/products-solutions/asphalt-recyclers.html, Aug. 15, 2013; p. 1-3.

(Pavement Technologies International Corp.), brochure for Mobile Asphalt Patching Machine PT 10-120; published at least as early as Aug. 2014; p. 1-6.

(Wikipedia, The Free Encyclopedia), webpage entry on Skid-Steer Loader: printed Aug. 26, 2014; p. 1-4.

(Pavement Technologies International Corp.), brochure for Mobile Asphalt Patching Machine PT R-10 Recycler; published at least as early as Aug. 2014; p. 1.

* cited by examiner

MOBILE MIXING DEVICES, SYSTEMS AND RELATED METHODS

RELATED APPLICATION

The presently disclosed subject matter claims the benefit of U.S. Provisional Patent Application Ser. No. 62/052,037, filed Sep. 18, 2014, the disclosure of which is incorporated herein by reference in its entirety.

TECHNICAL FIELD

The present subject matter relates to mobile mixing devices, mobile mixing systems, and related methods. In particular, the present subject matter relates to multiple purpose mobile mixing devices, multiple purpose mobile mixing systems, and related methods that can permit the separate processing of cement, concrete, and/or flowable fill and asphalt within the same mixing drum at different times.

BACKGROUND

For nearly a century, roads, driveways, walkways, runways, and other such surfaces over which vehicles travel have often been constructed using various types of asphalt or concrete. The viscous nature of the bitumen binder generally used with most types of asphalt allows the asphalt (sometimes referred to as asphalt concrete) to sustain significant plastic deformation. To increase strength and durable ability, roads, driveways, runways, and other such surfaces over which vehicles travel are often constructed with a gravel, a cement or concrete subgrade surface to add strength and an asphalt top, sometimes referred to as blacktop, which can provide a better elasticity to the surfaces, can better withstand weather changes, can reduce road noises, can wear better for increased longevity and can wear less on vehicle tires. Although asphalt provides a fair longevity to such road surfaces, fatigue from repeated loading over time is a common failure mechanism along with erosion or changes to the subgrade. Additionally, concrete, which can also have a fair longevity as a subgrade, can also succumb to fatigue, erosion and changes to the ground beneath the subgrade over time.

When repairing such roads, walkways, driveways, runways, and other such surfaces over which vehicles travel, the repair crew often needs to use both of some type of cement or concrete to provide, strengthen, or repair the subgrade and some form of asphalt to bring the damaged portion of the road surface to a more acceptably usable standard. In other instances, a repair site may require concrete repair at one location and asphalt repair at another location. Thus, to currently perform such repairs no matter how large or small, repair crews need to bring multiple pieces of equipment to each jobsite just to mix and process the materials used to repair the road. For example, a cement mixer will be needed to mix and process materials such as cement, concrete or flowable fill used to perform a concrete repair or to repair the subgrade. The repair crew will also need to haul asphalt from an asphalt plant or to bring along a separate and additional asphalt mixer, to mix the asphalt to be used to cover the repair subgrade. Due to the processing needs of each type of material, asphalt cannot be processed in a traditional cement mixer and cement, concrete or flowable fill generally cannot be processed in an asphalt mixer.

As such, a need exists for multiple purpose mobile mixing devices that can be used to quickly and easily process different types of materials used in repairing, road surfaces such as roadways, walkways, driveways, pathways, runways or other types of construction surfaces to reduce costs and processing times associated with extra equipment.

SUMMARY

The present subject matter provides mobile mixing devices, mobile mixing systems, and related methods. In particular, the present subject matter relates to multiple purpose mobile mixing devices, multiple purpose mobile mixing systems, and related methods to permit the separate processing of cement and/or flowable fill and asphalt within the same mixing drum at different times.

Thus, it is an object of the presently disclosed subject matter to provide mobile mixing devices, mobile mixing systems, and related methods that can reduce cost, time, and labor associated with processing different types of materials used in repairing construction surfaces. While one or more objects of the presently disclosed subject matter having been stated hereinabove, and which is achieved in whole or in part by the presently disclosed subject matter, other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

Figure 1A:
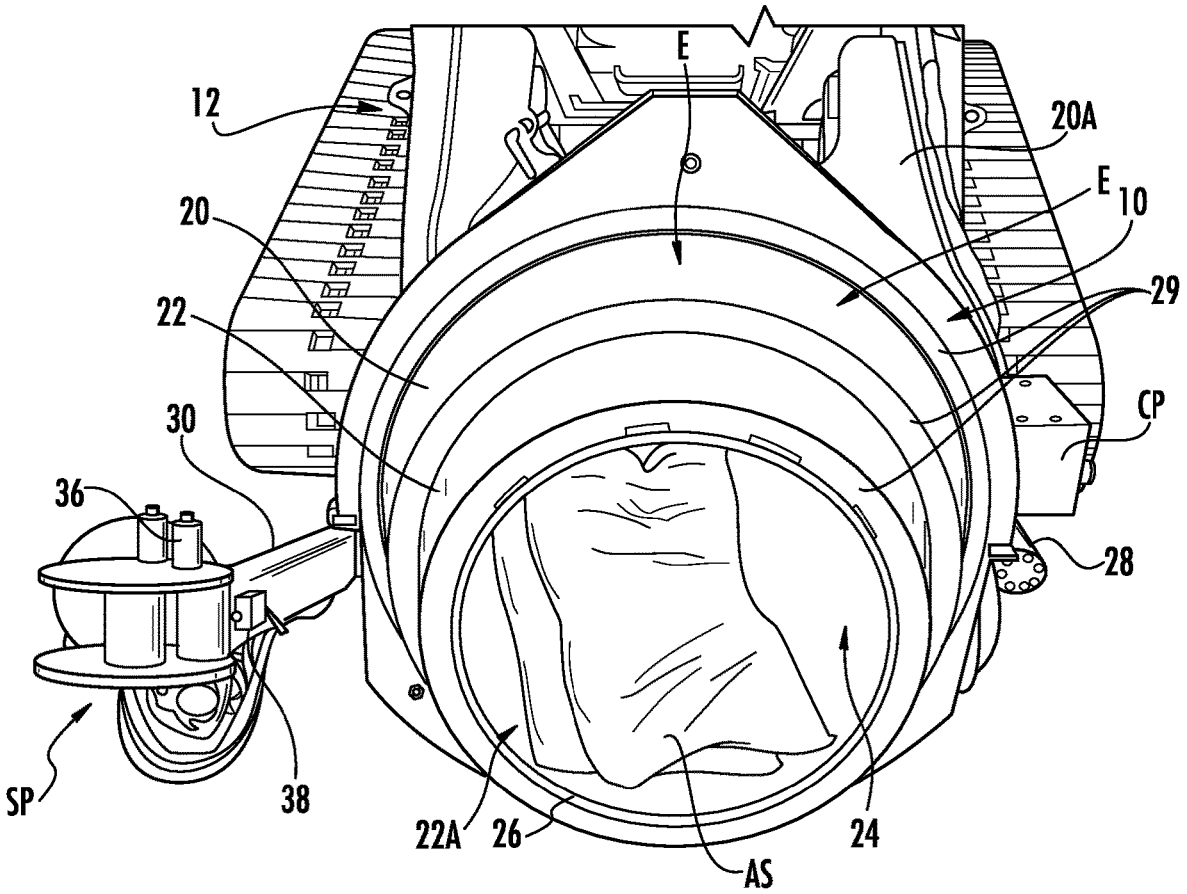
FIG. 1A illustrates a perspective view of an embodiment of a mobile mixing device loaded with bags of raw material in a mixing drum according to the present subject matter.

Repeat use of reference characters in the present specification and drawings is intended to represent the same or analogous features or elements of the present subject matter.

DETAILED DESCRIPTION

Reference now will be made to the embodiments of the present subject matter, one or more examples of which are set forth below. Each example is provided by way of an explanation of the present subject matter, not as a limitation. In fact, it will be apparent to those skilled in the art that various modifications and variations can be made in the present subject matter without departing from the scope or spirit of the present subject matter. For instance, features illustrated or described as one embodiment can be used on another embodiment to yield still a further embodiment. Thus, it is intended that the present subject matter cover such modifications and variations as come within the scope of the appended claims and their equivalents. It is to be understood by one of ordinary skill in the art that the present discussion is a description of exemplary embodiments only, and is not intended as limiting the broader aspects of the present subject matter, which broader aspects are embodied in exemplary constructions.

Although the terms first, second, right, left, front, back, etc. may be used herein to describe various features, elements, components, regions, layers and/or sections, these features, elements, components, regions, layers and/or sections should not be limited by these terms. These terms are only used to distinguish one feature, element, component, region, layer or section from another feature, element, component, region, layer or section. Thus, a first feature, element, component, region, layer or section discussed below could be termed a second feature, element, component, region, layer or section without departing from the teachings of the disclosure herein.

Similarly, when a feature or element is being described in the present disclosure as "above," "below,"" "on," or "over" another feature or element, it is to be understood that the features or elements can either be directly contacting each other or have another feature or element therebetween, unless expressly stated to the contrary. Thus, these terms are simply describing the relative position of the features or elements to each other and do not necessarily mean an absolute universal fixed position since the relative position above or below depends upon the orientation of the device to the viewer.

Embodiments of the subject matter of the disclosure are described herein with reference to schematic illustrations of embodiments that may be idealized. As such, variations from the shapes and/or positions of features, elements or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted or simplified to facilitate explanation of the subject matter disclosed herein. Thus, the features, elements or components illustrated in the figures are schematic in nature and their shapes and/or positions are not intended to illustrate the precise configuration of the subject matter and are not intended to limit the scope of the subject matter disclosed herein.

It is to be understood that the ranges and limits mentioned herein include all ranges located within the prescribed limits (i.e., subranges). For instance, a range from about 100 to about 200 also includes ranges from 110 to 150, 170 to 190, 153 to 162, and 145.3 to 149.6. Further, a limit of up to about 7 also includes a limit of up to about 5, up to 3, and up to about 4.5, as well as ranges within the limit, such as from about 1 to about 5, and from about 3.2 to about 6.5 as examples.

"Construction vehicle" as used herein means any vehicle used in the construction industry that can be modified or constructed to incorporate an operable mixing drum such that the construction vehicle can serve as a mobile mixing device. As used herein construction vehicles can include, but are not limited to, skid-steers, loaders, backhoes, tractors, flatbed trucks, dump trucks, cement mixer trucks, asphalt mixer trucks, or the like.

"Skid loader," "skid-steer loader," or "skidsteer," as used herein means a vehicle that is a small rigid frame, engine-powered machine with lift arms used to attach a wide variety of labor-saving tools or attachments. Many manufacturers have their own versions of this vehicle, including Bobcat, Terex, Case, Caterpillar, Gehl Company, Hyundai, JCB, JLG, John Deere, Komatsu, LiuGong, New Holland, Volvo, Wacker Neuson, and others.

"Mobile mixing device," "mobile mixing system", or "mobile mixer" as used herein means a portable device or system that comprises a portable multiple, purpose mixing drum that can be used to separately mix both cement and asphalt within the same drum. "Mobile mixing device," "mobile mixing system", or "mobile mixer" can include, but are not limited to construction vehicles outfitted with the multiple purpose mixing drum, a trailer outfitted with the multiple purpose mixing drum that is securable to a vehicle, a portable wheeled frame outfitted with the multiple purpose mixing drum, a portable stationary-legged frame outfitted with the multiple purpose mixing drum, a pug mill mixer, a cube cement mixer, mortar mixer or the like.

"Construction surface" as used herein means any construction that may or should include a layer of cement, concrete, flowable fill and/or asphalt therein or as layer that forms an outer surface of the construction. Construction surface can include, but are not limited to roadways, walkways, driveways, pathways, runways, stairs, walls, floors, roofs, foundations, or the like.

"Road surface" as used herein means any type or pathway that may or should include a layer of cement, concrete, flowable fill and/or asphalt therein or as layer that forms an outer surface of the pathway. Construction surface can include, but are not limited to roadways, walkways, driveways, runways, or the like.

A mobile mixer can be provided that can serve as a single mixing device both for mixing asphalt and for mixing concrete. In particular, the mobile mixer can serve as a multiple purpose mixing device both for mixing pelletized asphalt with aggregate to form a hot asphalt mix and for mixing concrete to form a concrete mix. For example, the mixer can heat bitumen, virgin asphalt, reclaimed asphalt pavement (RAP), pelletized asphalt, and/or other type mixtures of asphalt with or without aggregate to produce asphalt hot mix on site.

In some embodiments, a single device is provided which can be used to mix flowable fill and to heat asphalt for hot mix. This multiple use mobile mixing device eliminates an extra piece of equipment when using both flowable fill and asphalt together to repair damage to road surfaces, such as a potholes, road erosions, or road defects; to, repair other construction surfaces ordinarily made of, fitted with, or repaired with asphalt and concrete; to install new materials; or to pave in other construction site installations. Flowable fill is a type of fast setting cement that activates in a relatively very short time period (a few minutes) with water and this device offers the advantage of activation, mixing, and pouring into the final form within that short time period. Also, the flowable fill can form the subgrade for the asphalt. Flowable fill is a type of fast setting cement that activates in a few minutes after water is added.

The multiple purpose mobile mixing device can have a water supply inlet, a water supply, and/or a meter for facilitating the mixing of cement, concrete, flowable fill, or the like. In some embodiments, the multiple purpose mobile mixing device can have a water supply and a water meter attached so it is combined into one unit. By having a water supply disposed on the multiple purpose mobile mixing device that can provide a controlled and measurable water flow an accurate mixing can be achieved with the correct amount of water without having to be near an unaffiliated water source.

Due to the fast setting nature of flowable fill, the multiple purpose mobile mixing device can have a timer attached thereto that can track how long until the flowable fill sets up and to monitor the length of time in order to allow the asphalt to reach the optimal processing temperature. In some embodiments, such a timer can be integrated into a control of the multiple purpose mobile mixing device.

In addition, a water sprayer and pump can be attached to the mixing device to clean the mixer after using cement, or flowable fill, and before adding asphalt for the hot mix.

The multiple purpose mobile mixing device can comprise a removable cap to cover the mixer when processing flowable fill to eliminate the dust generated from the flowable fill during the mixing operation. The cap can be secured over the opening of the mixer after the flowable fill is placed in the mixer and removed from the opening before emptying the flowable fill from the mixer. The cap can have an opening therein to permit water to be added to the flowable fill within the mixer. In some embodiments, mobile mixing device can comprise a stow-away bin thereon into which the cap can be place when not in use.

The multiple purpose mobile mixing system of which the mobile mixing device is apart can comprise a small conveyor that can be used to load raw materials and/or the bags of cement, a flowable fill or bags of pelletized asphalt mix into the mixer depending on whether a cement, a concrete, a flowable fill, or an asphalt is being processed. The conveyor may sit on the ground, truck or trailer and project into the mixer. The conveyor can reduce the amount of labor required for shoveling or for lifting, the bags. Further, when using asphalt, the small conveyor can eliminate the need for a user to reach into the hot mixer.

The present subject matter also includes a method of using a single mixing device to first mix a fiowable fill therein to install new material at a construction site or repair defects in a construction surface first with flowable fill to form the subgrade. Then, using the multiple purpose mixing device to mix and heat an asphalt after cleaning the flowable fill from the mixer so that the asphalt can be placed over the hardened flowable fill. By using a single multiple purpose mixing, device, labor and equipment requirements and costs can be reduced and the speed of the process can be increased.

For a large multiple purpose mixer with a long mixing chamber, the heat flow from the entry to the far end is poor for mixers which have only one end open like cement mixers. This problem can be solved by placing a long vent tube extending near the closed end of the mixing chamber. This can exhaust the hot gases and provide uniform air flow along the length of the cylinder with an exhaust fan pulling the exhaust gas out of the tube. In the exhaust tube, the use of a smaller tube which intersects the larger exhaust tube at an angle of about 10 to 30 degrees can create a venturi effect when air is forced under pressure thru the smaller tube by an external fan and flows into the larger exhaust tube. This venturi effect creates air flow out of the exhaust tube which evacuates the hot gases from the mixer. The advantage of this arrangement is that the fan operates at ambient temperature with less opportunity to overheat from the hot exhaust gases as compared with some conventional asphalt recycler systems that either do not use a hot air extraction fan or use a high-temperature exhaust fan. The air flow can be adjusted by a damper to optimize the mixer heating performance. In some embodiments, a series of dampers, which are adjustable, can be used to adjust air flow to optimize the mixer heating performance. For example, the one or more dampers can be used to help even out the temperature of the hot mix along the length of the drum. The above described vent tube operates as a venturi that helps solve a problem of uneven heating of the material, which is commonly found in asphalt recyclers where temperature differentials in the mix between the front and rear of the mixer drum can be between about 75° F. and about 100° F. Thus, the above described vent tube operates as a venturi that can be used to improve air flow in existing asphalt recycler machines. Additionally, such a venturi device or system can also be used to improve air flow in existing cement mixers that can be converted into a multiple purpose mobile mixer.

When mixing the flowable fill, cement, or asphalt, the angle of the drum should be optimized depending on how much material is in the drum to achieve optimum mixer performance. To do this, a "tilt indicator" can be added to the drum which can be seen from the skid steer or other external device to give notice when the tilt of the mixer needs adjusting according to how much material is in the mixer to optimize performance.

In cold weather, a heater on board the mixer can be used to heat the repair site to dry moisture and achieve better adhesion of the asphalt prior to adding the asphalt. In some embodiments, a handheld torch separate from the primary burner can be used to heat and/or dry the repair site. Also, since the flowable fill (and cement) set time is temperature sensitive, the heater can adjust the mix temperature to shorten or adjust the reaction time in cold temperatures.

Thus, a single mobile mixing device can be used for mixing, processing, heating and discharging a variety of different materials. For example, the mobile mixing can mix concrete, flowable fill, reclaimed asphalt pavement (RAP), and/or virgin aggregates and/or pelletized asphalt for recycling or producing asphalt in either a cold or hot form by just cleaning the interior of the mixing device between uses.

This multiple function device eliminates the need for owning both a concrete mixer and asphalt plant and/or asphalt recycler. It also reduces labor and equipment requirements on a jobsite which calls for both concrete and asphalt materials to be used for the installation of new concrete and/or asphalt and/or the repair of existing concrete and/or asphalt.

The devices and systems offer the advantage of mixing, processing and pouring (discharging) the mixture of material into the final form within a few minutes. After a quick cleaning, the mixing device is then ready to be used for the same or different type of material. Thus, this mobile mixing device can be useful in performing repairs to either concrete structures or asphalt structures. Further, the mobile mixing device can also be useful in performing repairs to structures that contain both concrete and asphalt. For example, the mobile mixing device can be useful in performing repairs to roads or runways that may need both concrete repair and asphalt repair. Thus, such multiple purpose mixing devices and systems eliminate the need for owning both a flowable fill mixer and asphalt plant and/or asphalt recycler. It also reduces labor requirements and eliminates the need for an extra piece of equipment on a jobsite calling for both flowable fill and asphalt materials to be used for either the installation of new material and/or repair of existing concrete and/or asphalt. When flowable fill is used within the mobile mixing device, the mobile mixing device offers the advantage of activation, mixing, processing and pouring (discharging) the flowable fill into the final form within a few minutes. Further, the mobile mixing device can then be quickly cleaned and asphalt comprising reclaimed asphalt pavement (RAP), and/or virgin aggregates and/or pelletized asphalt can be mixed and processed into final application form in the mobile mixing device and then discharged from the mobile mixing device. Alternatively, another type of concrete can be mixed and processed into final application form in the mobile mixing device and then discharged from the mobile mixing device after the flowable fill. Thus the mobile mixing device is useful for applications where a flowable fill can form the subgrade for an asphalt or a concrete cover.

In some embodiments, the mobile mixing devices can be used by rental houses to rent to customers as a concrete mixer, an asphalt mixer, or an asphalt recycler or to customers who have both concrete and asphalt mixing needs. In situations where a customer rents the mobile mixing device for mixing concrete, the heater arm can be detached and stored by the rental house until its return by the customer. For example, in some embodiments, the heater support arm can comprise quick disconnect pins so that the heater support arm is easily removable and reattachable.

A mobile mixing device attachment for a construction vehicle can be designed to attach to and detach from the respective construction vehicle rapidly and with ease to turn the construction vehicle into a multiple purpose mobile mixing device. As an example, a mobile mixing device attachment that can be used with a skid-steer is described below with reference to FIGS. 1-7. The mobile mixing device attachment can be rapidly attached to the skid-steer arms for deployment as a multiple purpose mobile mixing device at a repair site. Materials can be quickly heated, mixed and discharged from the multiple purpose mobile mixing device on the damaged area to be fixed at the repair site. By using the mobile mixing device attachment, the multiple purpose mobile mixing device can be used to process flowable fill, cement or asphalt. For example, multiple purpose mobile mixing device can be used to process recycle asphalt millings and produce airfield grade virgin asphalt.

Referring to FIGS. 1A-7, an embodiment of a multiple purpose, mobile mixing device, generally designated 10, is provided. The mobile mixing device 10 can comprise a frame, generally designated 12, that can provide stability and mobility to the mobile mixing device 10. In some embodiments, the frame 12 can comprise a construction vehicle, such as a skid-steer, as shown in the embodiment of FIGS. 1A-7. The mobile mixing device 10 can also comprise a mixing drum 20 securable to the frame 12. The mixing drum 20 can comprise a body 22 that forms an internal cavity 24 and having a forward end 22A and a bottom end 22B (see FIGS. 4 and 5, for example). The mixing drum 20 can also comprise a mouth 26 at the forward end 22A of the body 22 that provides access to the internal cavity 24 of the mixing drum 20. Further, the mobile mixing device 10 can comprise a movable heater mount that includes a heater support arm 30 comprising a heater 32 secured to an end 34 of the heater support arm 30 that is distal from the mixing drum 20. The heater 32 can be, for example, a burner of some type. The heater support arm 30 can be movable between a stow-away position SP (see FIGS. 1 and 5) such that the heater support arm 30 is off to a side of the mixing drum 20 and a heating position HP (see FIGS. 3B, 3C, and 4) with the heater 32 facing into the mouth 36 of the mixing drum 20. For example, the heater support arm 30 can be foldable between a stow-away position SP and a heating position HP. Further, the mobile mixing device 10 can comprise a mixing drum drive 28 engageable with the mixing drum 20 to rotate the mixing drum 20.

Figure 2:
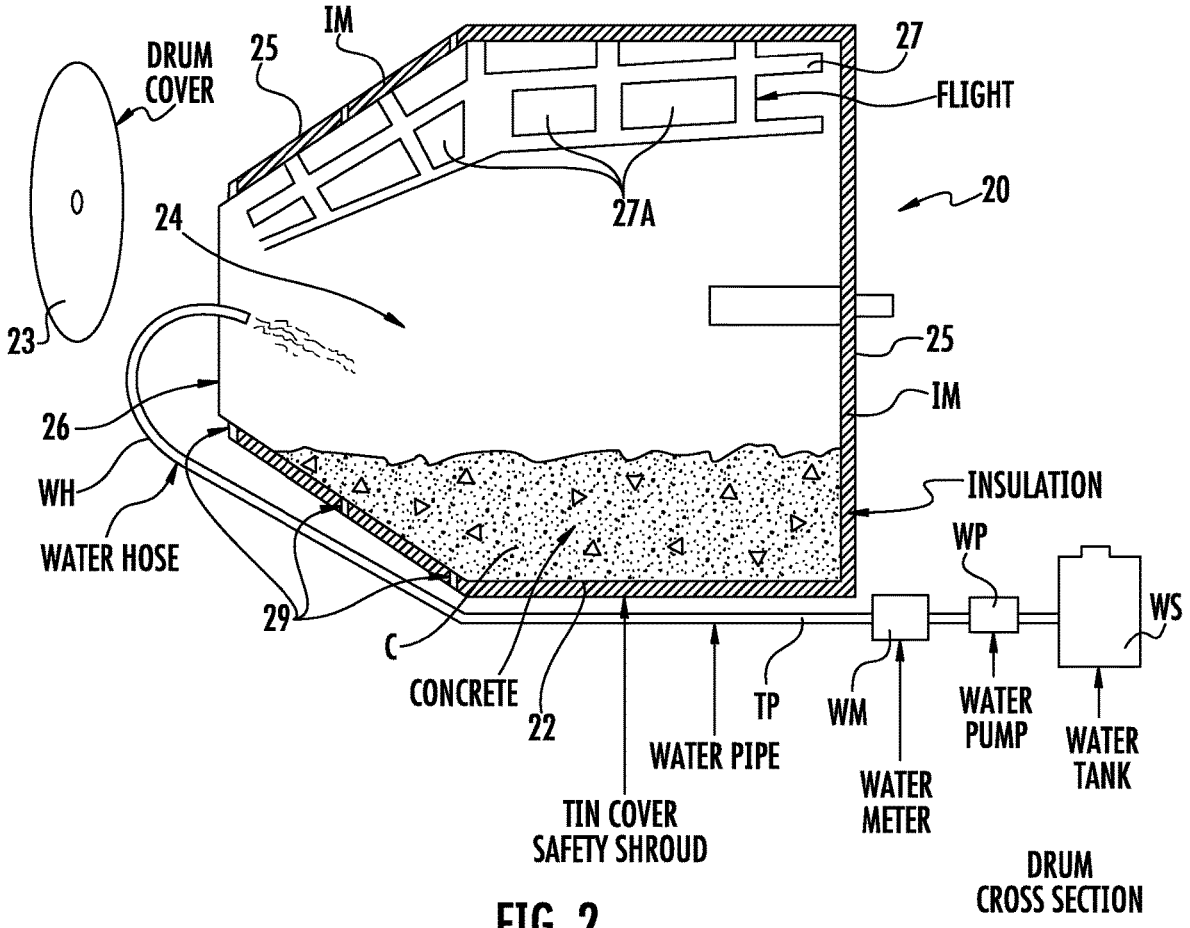
FIG. 2 illustrates a cross-sectional view of another embodiment of the mixing drum according to the present subject matter of the mobile mixing device according to FIG. 1A, the mixing drum being loaded with raw material used in mixing cement, concrete or flowable fill.

Thus, through the use of the single mobile mixing device 10, the mixing drum 20 can process flowable fill, concrete, and/or some other cement-based product in the internal cavity 24 of mixing drum 20 when the heater support arm 30 is in the stow-away position SP as shown in FIG. 2. Additionally, the mixing drum 20 of the same single mobile mixing device 10 can be used to process asphalt by moving the heater support arm 30 into the heating position HP with the heater 32 facing into the mouth 26 of the mixing drum 20 to heat the asphalt material loaded into the internal cavity 24 of mixing drum 20 through the mouth 26 as shown in FIGS. 3A-7. Thus, the single mobile mixing device 10 can process a flowable fill, concrete, and/or some other cement-based product and an asphalt product with only a cleaning between the mixings.

In more detail, the mobile mixing device 10 can comprise the heater support arm 30 that allows contents such as asphalt material AS (see FIGS. 1A and 3A) placed within the mixing drum 20 of the mobile mixing device 10 to be heated to a proper temperature for mixing different kinds of asphalt. The heater support arm 30 has heater 32, which serves as a heat source. For example, the heater 32 can comprise a flame torch that can generate a large amount of heat within the drum 20. The heater support arm 30 can be pivotally mounted proximal to the mouth 26 of the drum 20 and can swing into a position that allows heat generated by the heater 32 to enter the mixing drum 20 through a central portion of the mouth 26 of the mixing drum 20.

Figure 3A:
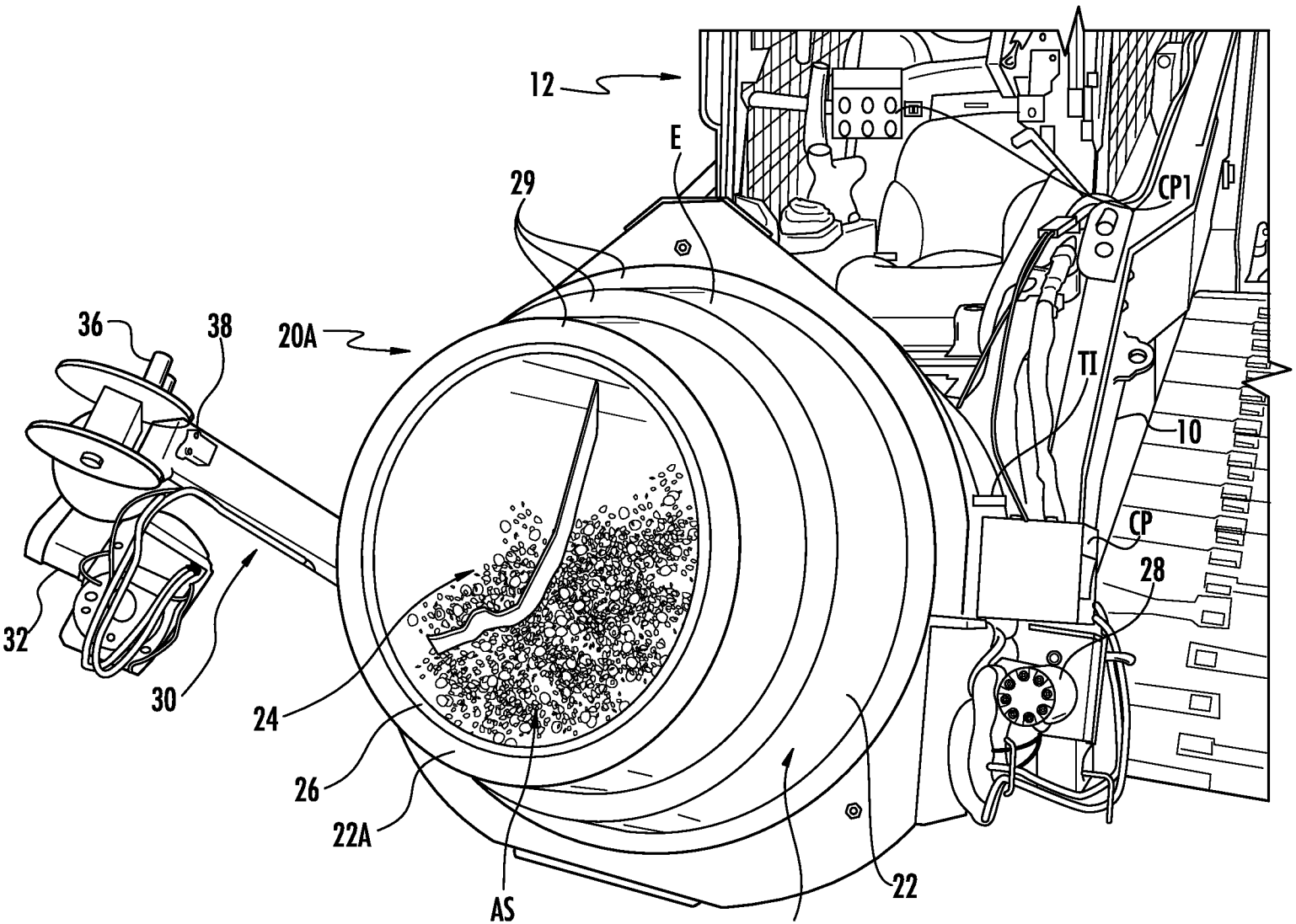
FIG. 3A illustrates a perspective view of the embodiment of the mobile mixing device according to FIG. 1A with a heater support arm in a stow-away position and loaded with raw material in the mixing drum for mixing asphalt.
Figure 3B:
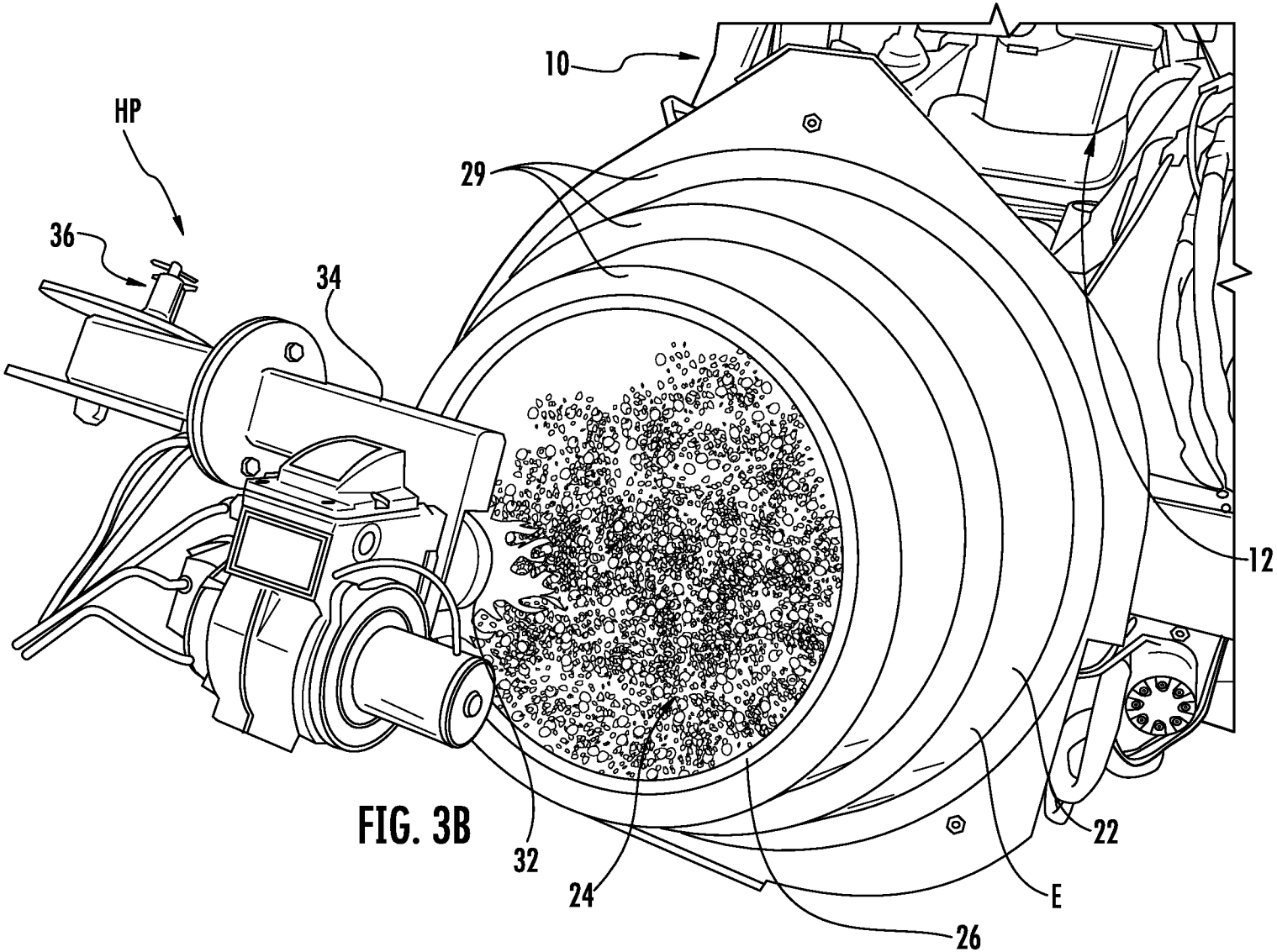
FIG. 3B illustrates a perspective view of the embodiment of the mobile mixing device according to FIG. 1A with a heater support arm in a heating position with a heater running and loaded with raw material in the mixing drum for mixing asphalt.
Figure 3C:
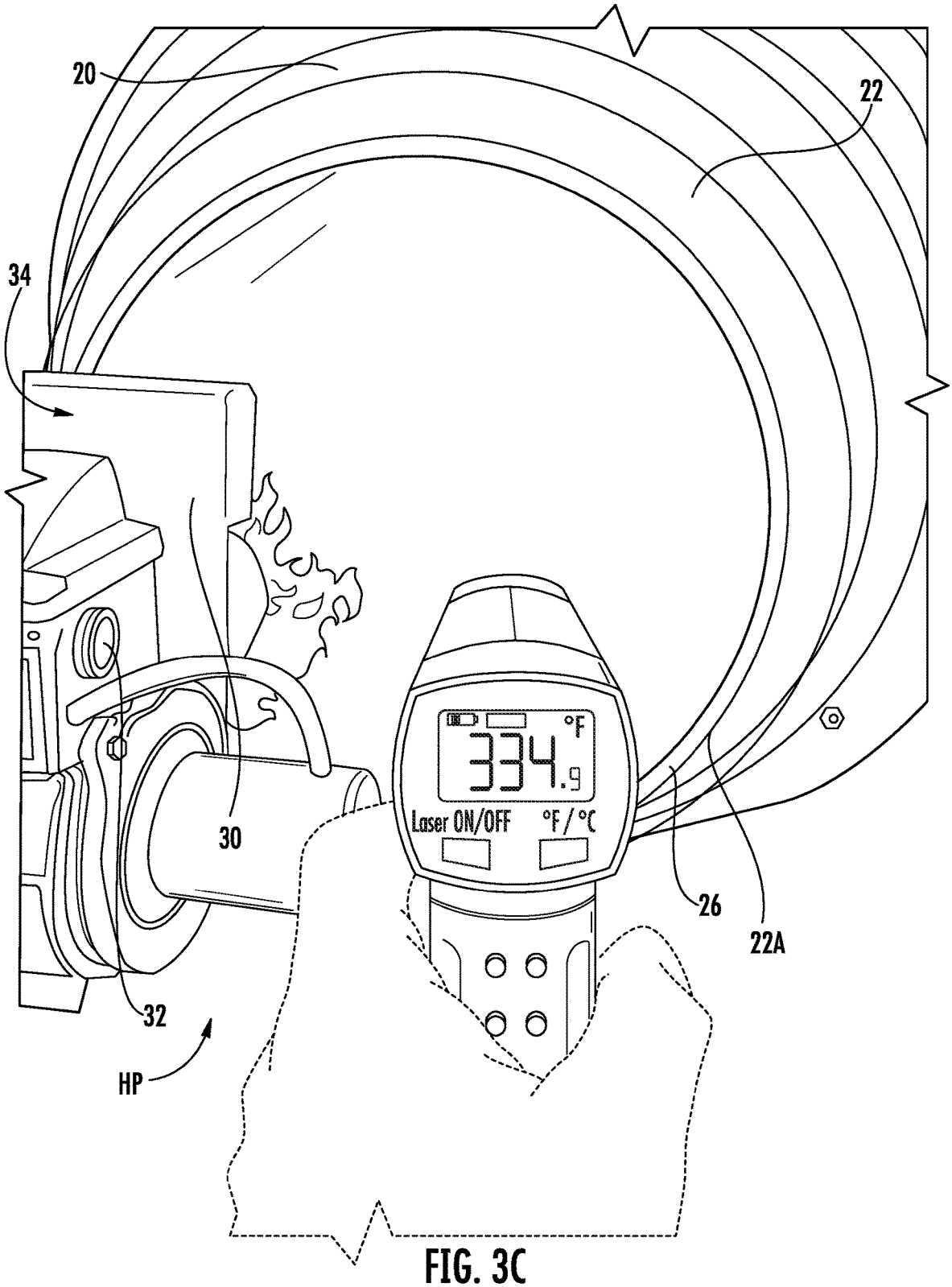
FIG. 3C illustrates a perspective view of the embodiment of the mobile mixing device according to FIG. 1A with a heater support arm in a heating position with a heater running at a high temperature.
Figure 5:
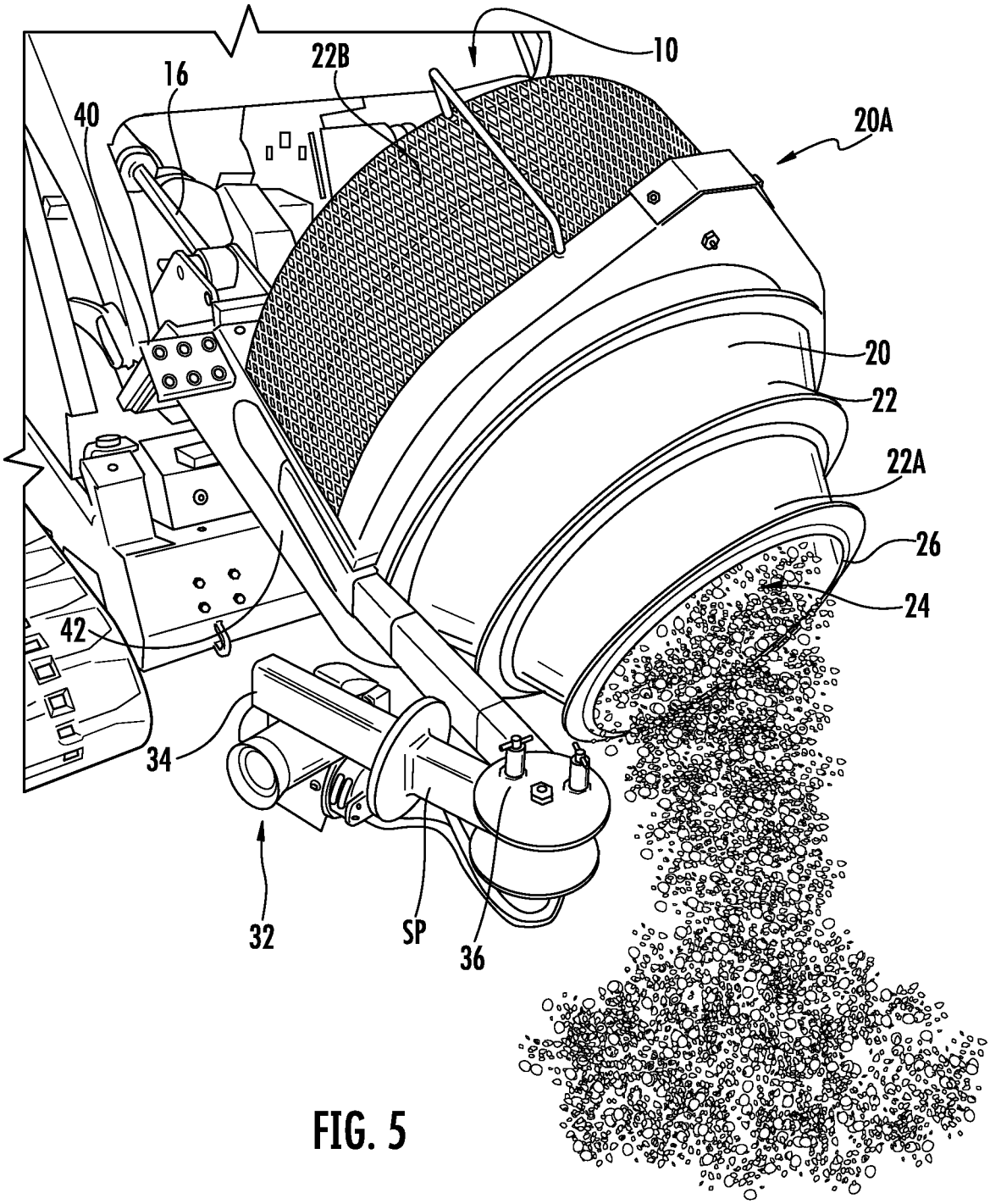
FIG. 5 illustrates a perspective view of the embodiment of the mobile mixing device according to FIG. 1A with the heater support arm in the stow-away position and the mixing drum in a dumping position.

For example, the heater support arm 30 can be pivoted around a locking pivot 36 to lock the heater support arm 30 and heater 32 in the stow-away position SP when dumping the contents of the drum 20 as shown in FIG. 5 or when mixing cement or concrete as shown in FIG. 2. The heater support arm 30 can be pivoted around a locking pivot 36 to lock the heater support arm 30 and heater 32 in the heating position HP when heating asphalt mix that has been loaded into the mixing drum 20 as shown in FIGS. 3B and 3C. In some embodiments, the heater support arm 30 can comprise a hydraulically activated folding burner arm that allows the heater 32 to move into proper positions for heating and for discharging mix. In some embodiments, the heater support arm 30 can have a safety activation switch 38 that prevents the heater 32 from producing heat until the heater support arm 30 is locked into the heating position HP. To turn the heater 32 on and off, a heater on/off switch can be provided. Timers for controlling the amount of time that the heater 32 is activated can be in operable communication with the heat source of the heater 32. A control panel in proximity to the mixing drum 20 that can operate wirelessly or through a wired connection can include controls for the mixing drum 20, the heater support arm 30, a heater on/off switches, and the timers. In some embodiments, the control panel can be located in the cab, of the construction vehicle 12 or outside the cab of the construction vehicle 12 in proximity of the mixing drum 20. For example, as shown in FIG. 1A, in some embodiments, the control panel CP can be a removable control box that can be tethered to the mobile mixing drum device 10. In some embodiments, as shown in FIG. 3A, a control panel CP1 can have controls for operating the heater 20, heater support arm 30, the mixing drum 20 and the timers by wireless or wired communications. The control panel CP1 can be located in the cab of the construction vehicle 12 instead of or in additional to a control panel CP outside the cab of the construction vehicle 12. Thus, the heater support arm 30, a heater on/off switches, and timers can be activated by the operator at the mobile mixing device 10. The control panel CP1 can comprise a set of separate individual controls for the various components of the mobile mixing device and/or can comprise a computer that can be used to monitor and operate the various components. In various embodiments, the control panel CP or control panel CP1 can also be in communication with sensors such as temperature sensors with the drum, tilt level indicators TI, liquid tank sensor, etc.

Figure 1B:
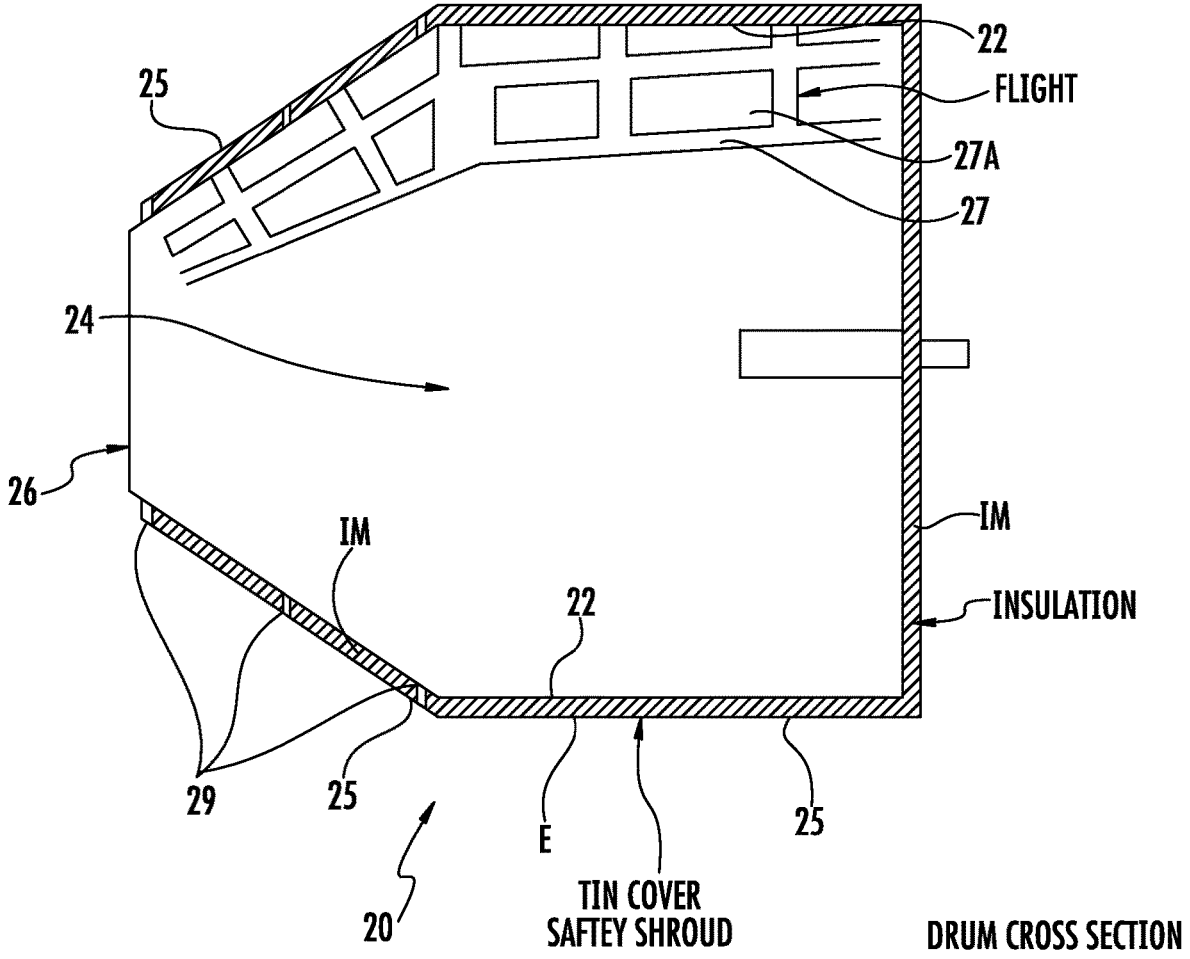
FIG. 1B illustrates a cross-sectional view of another embodiment of the mixing drum according to the present subject matter of the mobile mixing device according to FIG. 1A.

In some embodiments as shown in FIGS. 1B and 2, the mixing drum 20 can comprise one or more baffles, or flights, 27 extending inward from the body 22 of the mixing drum 20 into the internal cavity 24 for agitating or mixing the contents poured or otherwise loaded in the internal cavity 24 of the mixing drum 20. For example, the one or more flights 27 can have apertures 27A therein for facilitating the mixing of the contents in internal cavity 24. For example, the contents can be a concrete, cement or flowable fill material C as shown in FIG. 2 that can be mixed with aggregates or other material to make concrete or cement. Alternatively, the contents can be an asphalt material AS as shown in FIGS. 1A and 3A that can be mixed with aggregates or other material to make an asphalt. The flights 27 are useful for mixing the contents loaded in the internal cavity 24 of the drum 20 for mixing, processing and discharging, concrete, asphalt and flowable fill products. This allows a single mixing device 10 to be used for all three products: flowable fill, different types of cement, and different types of asphalt.

The mixing drum 20 of the mobile mixing device 10 can comprise stiffening rings 29 secured to the exterior E of the drum 20. The stiffening rings 29 can reduce or prevent the drum 20 from warping during the mixing and heating of materials. These rings 29 can be welded to the exterior E of the drum 20, running around the circumference of the body 22. The stiffening rings 29 at strength to the drum 20 to allow the mixing drum 20 to serve multiple mixing functions.

Additionally or alternatively, as shown in FIGS. 1B and 2, the mixing drum 20 of the mobile mixing device 10 can comprise an external safety shroud 25 that can be fitted around the exterior of the mixing drum 20. The external safety shroud 25 can form an exterior E for the mixing drum 20 that creates separation between the metal body 22 of the drum 20 and the exterior of the safety shroud 25 to reduce the heat transfer to the exterior of the safety shroud 25. The safety shroud can comprise a thermally insulative material IM that reduces heat transfer from the body 22 of the mixing drum 20 to the exterior of the safety shroud 25. As shown in FIGS. 1B and 2, the insulative material IM around the body 22 with the safety shroud 25 covering the insulative material IM. The insulative material IM can improve heat retention within the mixing drum, improve fuel efficiency of the heater by reducing time needed for heating asphalt material and reduce operation costs. As shown in FIG. 2, a cover, or cap, 23 for the drum 20 can be provided. The cap 23 can be useful for covering the opening when mixing a concrete, cement or flowable fill material C to reduce the amount of dust escaping from the drum 20 during mixing. The cap 23 can also be helpful in some embodiments in retaining heat in the drum 20 during the process mixing asphalt material after the asphalt material has been heated. As shown, in some embodiments, the insulative material IM can be placed between the stiffening rings 29 with the safety shroud 25 extending above the stiffening rings 29. In some embodiments, a layer of the insulative material can extend over the top of the outer portions of the stiffening rings 29. Further, in some embodiments, a space can be provided between the body 22 of the mixing drum 20 and the safety shroud 25 to provide an insulative layer of air therebetween. Such a safety shroud 25 can reduce the likelihood of a person contacting the drum mixer while it's moving and/or hot. The same or an additional safety shroud can also provide a cover over the pivot portion of the heater support arm 30 to reduce the opportunity of a pinching hazard.

As shown in FIG. 2, some embodiments of a mobile mixing device can include a water supply WS (water storage tank), a pump WP, water transport plumbing TP and a water meter WM for providing water into the mixing drum 20. The water can be used as a component of cement or flowable fill used in the mixing drum and/or as a cleaning fluid for rinsing out and cleaning the mixing drum 20 after each use. The cleaning of the drum 20 after each use allows for the multiple purpose mobile mixing device to separately process flowable fill, different types of cements, and different types of asphalts in a single mixing drum 20. The water can be metered using the water meter WM that can measure the water that is being supplied to the drum, for example, 0.1 gallons or 0.01 gallons. This allows accurate mixing with the correct amount of water when mixing concrete and flowable fill. In some embodiments, a control can be provided on a control panel CP or control panel CP1 to control the flow of water from the water supply WS through the water meter WM. In some embodiments, the control panel can be a computer with a computer interface or display for the user can be in operable communication with the water meter to allow the flow of water into the mixing drum to be monitored and/or controlled. A flexible hose WH can be secured to an end of the transport plumbing TP to allow the operator to direct the spray of water as needed or desired.

In some embodiments, the mobile mixing device can comprise a water hookup valve with plumbing to attach a separate water supply, for example, a valve for connecting a hose that is connected to a spigot stationed near the desired location of use of the mobile mixing device. In some embodiments, the mobile mixing device can comprise a water hookup valve to attach a separate water supply and a water meter secured to the water hookup valve to measure the amount of water being supplied through the valve.

In some embodiments where the mobile mixing device 10 comprises a construction vehicle, such as a skid-steer 12, the mixing drum 20 can comprise a portion of a mixing drum attachment 20A. Such mobile mixing device 10 can be transported and utilized in several ways. In some embodiment, the skid-steer 12 along with one or more attachments including the mixing drum attachment 20A can be placed on a trailer with the skid-steer 12 and transported to a desired location. Other skid-steer attachments can also be included on the skid-steer and/or trailer, including a bucket attachment, a power-driven auger attachment, a trencher attachment, pallet fork attachments, a dumping hopper attachment, a jackhammer attachment, a tiller attachment or the like. Further, the mixing drum attachment 20 can be configured to attach to the skid-steer 12 in some combination with other attachments including: implement/attachment using a standard mounting plate 40 (see FIGS. 4 and 5) for a skid steer 12, bucket loader or tractor, directly attachable to the bucket of a skid-steer or bucket loader, or the like.

The mobile mixing device attachment 20A can comprise the mixing drum 20 that is rotatably secured between attachment plates 42 that can attach to the skid-steer 12. The heater support arm 30 of mobile mixing device attachment 20A can operate separately from the attachment plates 42 when moving between the heating position HP in front of the mouth 26 of the mixing drum 20 and an idle position SP to one side of the mixing drum body 22. When folded into the heating position, the heater 32 can be ignited to supply heat directly into the mouth 26 of the mixing drum 20 to heat contents placed in the internal cavity 24 of the mixing drum 20 to process the contents of raw material into asphalt, to recycle asphalt or to heat water.

Figure 7:
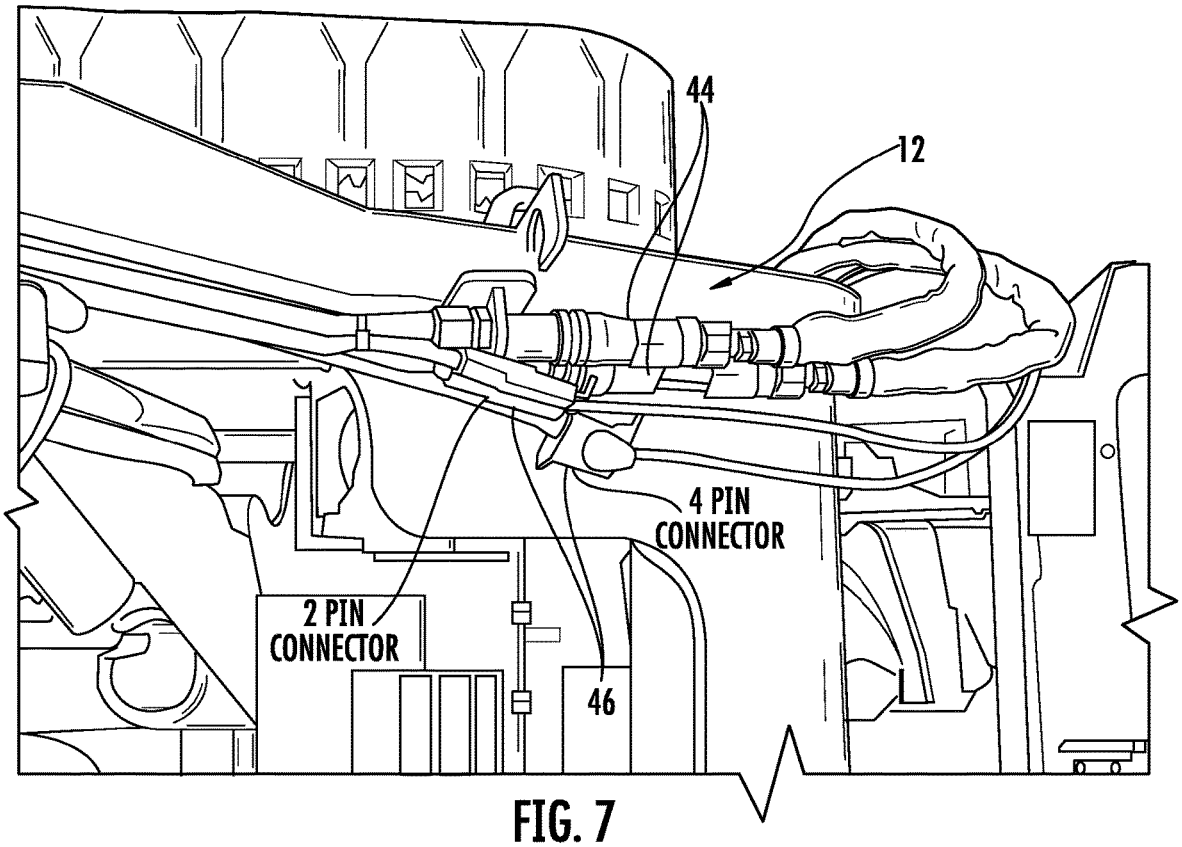
FIG. 7 illustrates a perspective view of a portion of the embodiment of the mobile mixing device according to FIG. 1A showing connections for a mixing device attachment.

In some embodiments, the mobile mixing device attachment 20A can also comprise a drum drive 28 that can be powered separately and independently from the power system of the skid-steer 12. In some embodiments, the drum drive 28 can be powered by the power system of the skid-steer 12. For example, in some embodiments, the mobile mixing device attachment 20A can get its power supply directly from the hydraulics and electric system of the skid-steer 12. Quick connects 44 for hydraulic and quick connects 46 for electric as shown in FIG. 7 allow the mobile mixing device attachment 20A to be mounted in minutes. In some embodiments, quick connects similar to those shown in FIG. 7 can be used to connect a 12-volt power supply to the heater, switch wire for the heater, return and supply hydraulic connections, return and supply fuel connections, and/or a supply connection for water tank.

Figure 6:
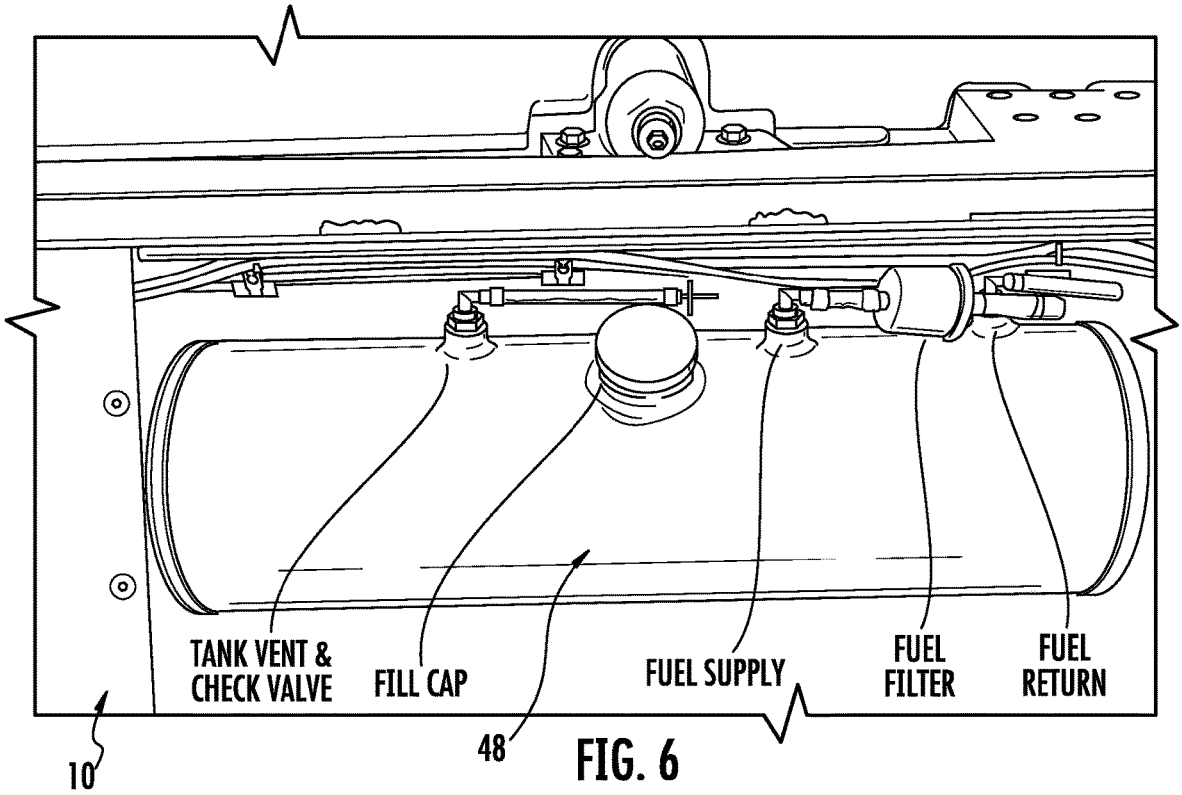
FIG. 6 illustrates a perspective view of a portion of the embodiment of the mobile mixing device according to FIG. 1A showing an integral fuel tank.

In some embodiments, an independent fuel supply as shown in FIG. 6 can be provided to supply power to the heater 32. In particular, an independent fuel tank 48 as shown in FIG. 6 can be provided to supply fuel to the heater 32. In some embodiments, the fuel can be supplied from the fuel tank of the vehicle to which it is attached, such as the fuel tank of the skid steer.

Figure 4:
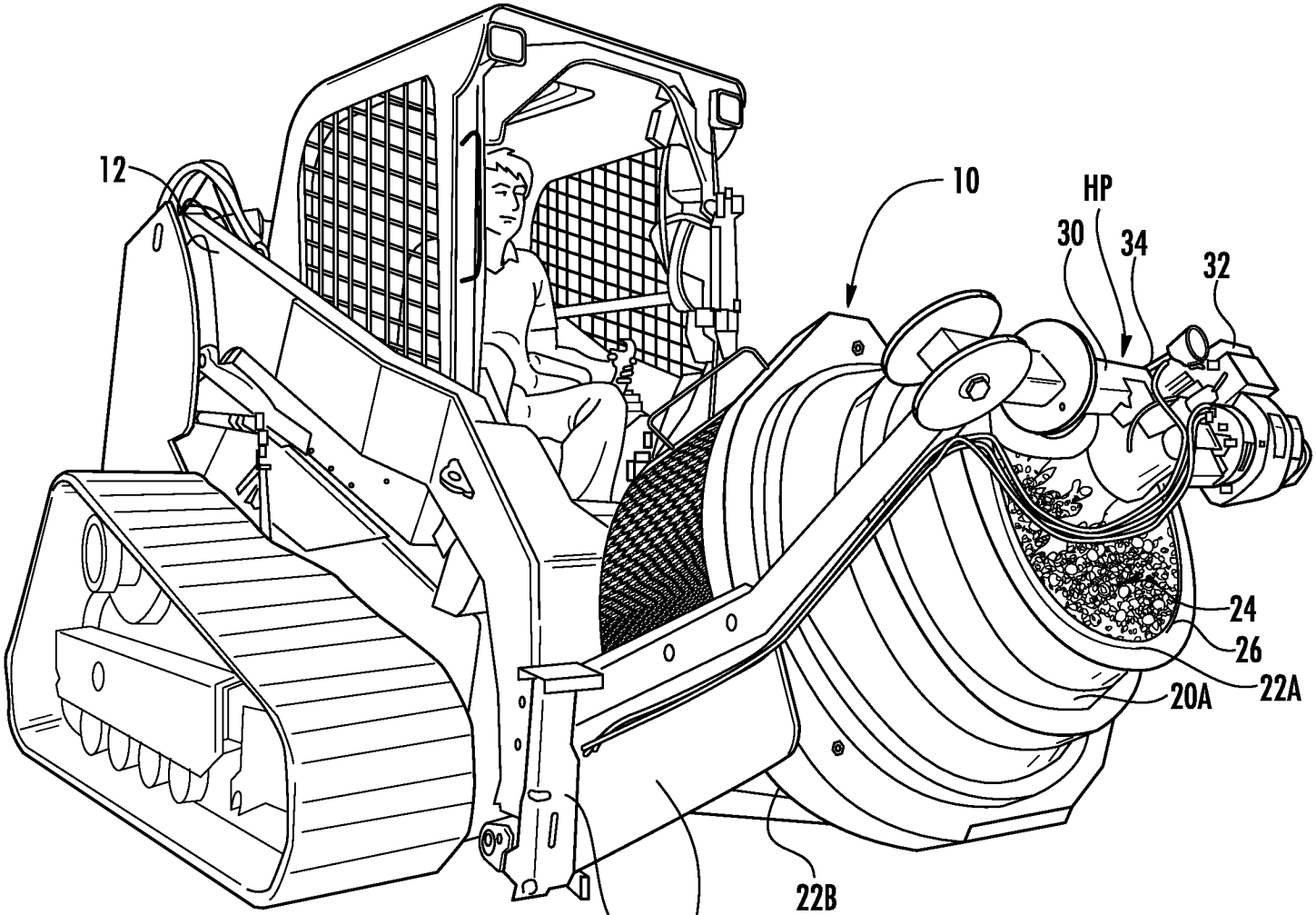
FIG. 4 illustrates a side perspective view of the embodiment of the mobile mixing device according to FIG. 1A with a heater support arm in a heating position with a heater running and loaded with raw material for mixing asphalt.

The mounting plate 40 and/or the attachment plates 42 of the mobile mixing device attachment 20A can be secured to hydraulic pistons 16 (see FIG. 5) that can permit the tilting of the mixing drum 20 between different positions. These positions can include an upright position for mixing the materials placed in the mixing drum 20 as shown in FIG. 4, an intermediate loading position for loading materials through the mouth 26 and into the internal cavity 24 of the mixing drum 20 as shown in FIG. 1, and a dumping position for dumping the processed product out of the mouth 26 of the mixing drum 20 at the desired location as shown in FIG. 5. Further, in some embodiments, the mixing drum 20 can be tilted to one or more angles and positions between these three described positions.

The operator can have full control of the mixing drum rotation speed/direction, heating, and dumping, directly from an operator console or control panel, which can be a panel of separate controls or a computer that has controls in the form of operable programs therein. When processing asphalt in the mixing drum 20, millings or aggregate and pelletized asphalt can be placed into the internal cavity of the mixing drum 20 as shown in FIGS. 1A and 3A. The heater support arm 30 can be moved and locked into the heating position HP for heating the mix in the rotating mixing drum 20 as shown in FIGS. 3B, 3C and 4. Once the material reaches the desired temperature, the operator can stop the heater 32 and can lock the heater support arm 30 in the idle position, or stow-away position, SP. The operator can then drive the skid steer 12 to the repair site and can discharge the mix in the appropriate location as shown in FIG. 5.

As stated above, power can be supplied to drive the mixing drum of the mobile mixing devices in several manners. In some embodiments, the mixing drum or mobile mixing device attachment can have an integral self-contained power source that is independent from and external to the power source for the construction vehicle on which the mixing drum or mobile mixing device attachment is configured. In some embodiments, the mixing drum or mobile mixing device attachment can have an external power source that is separate from the mixing drum or mixing drum attachment. Such external power sources can also be independent from and external to the power source for the construction vehicle or other machine to which the mixing drum or mobile mixing device attachment, is configured. Such external power sources can comprise one or more engines (gas, diesel, LPG, natural gas), electric motors, or hydraulic drives and/or other electrically powered drives powered via a generator or wall style outlet. In some embodiments, the mixing drum or mobile mixing device attachment can be powered by the internal power source of the construction vehicle or other machine to which the mixing drum or mobile mixing device attachment is configured.

Fuel and/or power used to power the heater and its heat source can also be supplied in different manners. For example, for embodiments where the mixing drum or mobile mixing device attachment has an integral self-contained independent power source, a fuel supply can be provided by an integral onboard fuel tank as mentioned above. For example, a fuel tank can also be provided, for the heater, even when the machine is being powered by the skid-steers hydraulics. Additionally or alternatively, the power source for the mixing drum or mobile mixing device attachment can comprise fittings to receive fuel from an external fuel supply. Such fuel can be used by the heater to create the heat needed to heat the raw materials for the processing of asphalt.

Figure 8A:
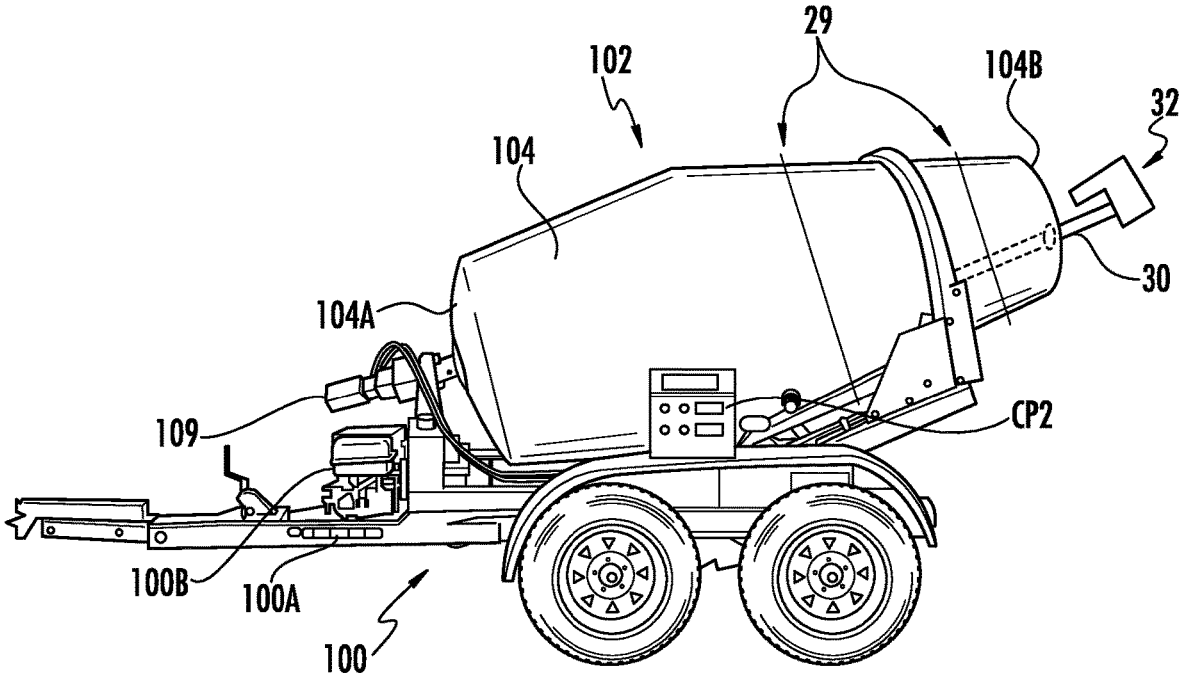
FIG. 8A illustrates a perspective view of another embodiment of a mobile mixing device according to the present subject matter.
Figure 8B:
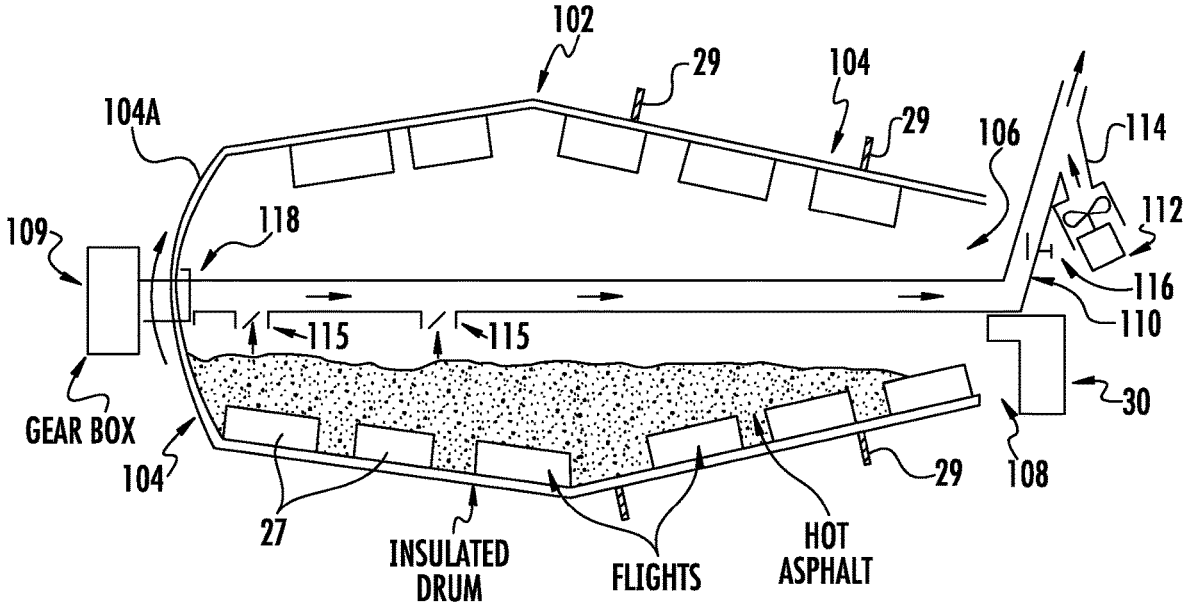
FIG. 8B illustrates a cross-sectional view of the embodiment of the mixing drum of the mobile mixing device according to FIG. 8A.

FIGS. 8A and 8B illustrate another embodiment of a mobile mixing device 100, which can comprise a mixing drum 102 on a trailer 100A. The mixing drum 102 with a body 104 that forms an elongate internal cavity 106 with a larger volume for processing at a closed end 104A and narrower portion at an end 104B that forms a mouth 108 (see FIG. 8B) of the mixing drum 102. As with previous embodiment, the mobile mixing device 100 can also comprise a movable heater mount that includes a heater support arm 30 comprising a heater 32 secured to an end of the heater support arm 30 that is distal from the mixing drum 102. The heater 32 can be, for example, a burner of some type. The heater support arm 30 can be movable between a stow-away position such that the heater support arm 30 is off to a side of the mixing drum 102 and a heating position with the heater 32 facing into the mouth 36 of the mixing drum 20. As shown in FIGS. 8A and 8B, the heater support arm 30 is in the heating position. The trailer 100A can have a fuel/power source 100B thereon for powering the mobile mixing device 100 and more particularly the rotation and tilting of the drum 102 and the powering of the heater 30 and, in some embodiments, the heart support arm 30. A control panel CP2 can be used to control the various operations of the mobile mixing device as described above in reference to previous embodiments. The control panel CP2 can be a set of individual controls or can be a computer with a computer interface that has controls in the form of control programs stored thereon to operate such components as the mixing drum, the heater, the heater support arm and other components of the mobile mixing device 110.

Also as with the previous embodiment, of the mobile mixing device 100 can comprise stiffening rings 29 secured to frustoconical portion at the end 104B of the body 104 of the drum 102. The stiffening rings 29 can reduce or prevent the drum 102 from warping during the mixing and heating of materials. The mobile mixing device 100 can comprise a drum drive 109 as discussed above.

As shown in FIG. 8B, the mobile mixing device 100 can comprise a removable vent tube 110 that can extend within the internal cavity 106 from the closed end 104A of the body 104 through the mouth 108 of the mixing drum 102 to facilitate circulation of heat and exhaust air from within the internal cavity 106. As with other embodiments described above, a heating source 30 can be used to provide heat into the internal cavity 106 of the mixing drum 102. The vent tube 110 can exhaust hot gases from the internal cavity 106 and increase the uniformity of hot air flow along the length of the internal cavity 106 of the mixing drum body 104 with an exhaust fan 112 for evacuating exhaust, gases out of the tube 110. In particular, the exhaust fan 112 can below air into the vent tube 110 to create greater airflow in the vent tube 110 below where the air is added. The arrangement of the fan tube 112 with the vent tube 110 creates a venturi which amplifies the air flow from the fan 112 through the fan tube 114 causing an increased flow of air in the exhaust tube 110. A damper 116 can be provided on the vent tube 110 to adjust the air flow to optimize the mixer heating performance. In some embodiments, the fan 112 and/or the damper 116 can be controlled by the control panel CP2. In some embodiments, the damper 116 can be controlled manually. In particular, the fan 112 pulls air that is at an ambient temperature outside the drum 102 and blows it into the vent tube 110 to create a negative pressure differential in the vent tube 110 to pull the hot air and gases down within the drum 102 into hot gas suction inlets 115 in the vent tube 110 positioned at the back of the drum 102 and then outward through the vent tube 110 as explained in more detail below with reference to FIG. 8C. A ceramic bearing 118 can be used to stabilize the vent tube 110 within the mixing drum 102 without rotating with mixing drum 102.

Figure 8C:
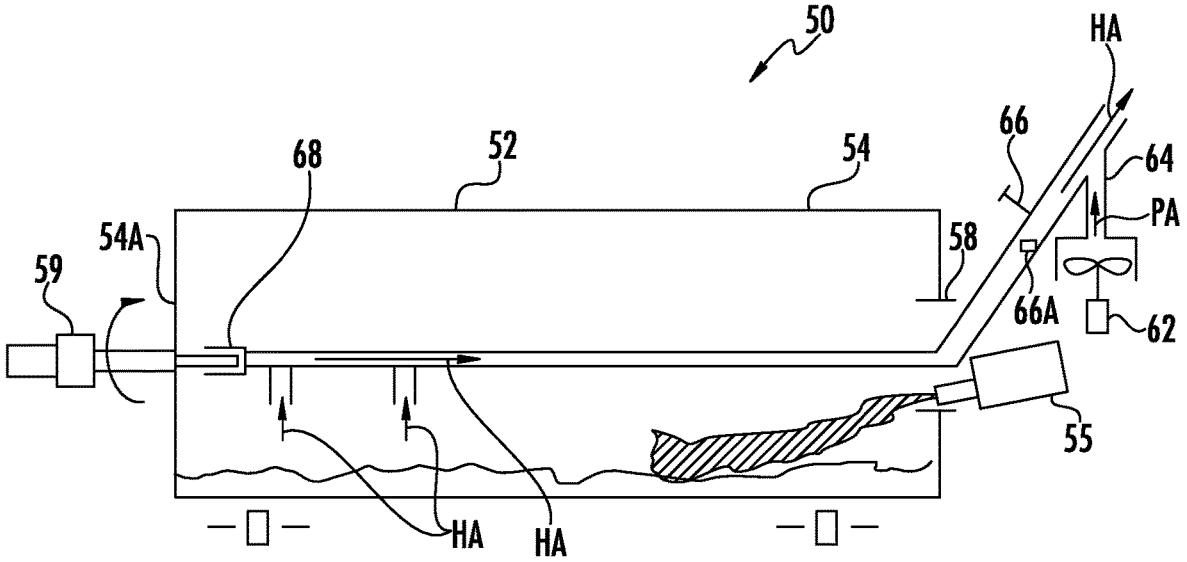
FIG. 8C illustrates a cross-sectional view of a further embodiment of a mobile mixing device according to the present subject matter.

In some embodiments as shown in FIG. 8C, a mobile mixing device 50 can comprise a mixing drum 52 with a body 54 that forms an elongate internal cavity 56 in which a vent tube 60 extends from a mouth 58 of the mixing drum 52 to a point near the closed end 54A of the mixing drum body 54. As with other embodiments described above, a heating source 55 can be used to provide heat into the internal cavity 56 of the mixing drum 52. The vent tube 60 can exhaust hot gases and air HA from the internal cavity 56 and increase the uniformity of hot, air flow along the length of the internal cavity 56 of the mixing drum body 54 with an exhaust fan 62 for evacuating exhaust gases out of the tube 60.

For example, the exhaust fan 62 can comprise a high pressure fan 62 that adds air PA to the vent tube 60 to create greater airflow in the vent tube 60 below where the air is added. The intersection of the smaller vent tube 64 with the exhaust tube 60 at an angle of about 10 to 30 degrees creates a venturi which amplifies the air flow from the fan 62 through the smaller tube 64 causing a flow in the exhaust tube 60. In particular, the high pressure fan 62 can be attached to an auxiliary conduit 64 that branches off from the main vent tube 60. The high pressure fan 62 can blow air PA into the auxiliary conduit 64. The blown air PA then travels into the main vent tube 60. The blown air PA can create a negative pressure differential in the portion of the vent tube 60 below where the auxiliary conduit 64 connects to the vent tube 60, causing a greater airflow to be pulled through the vent tube 60. The high pressure fan 62 and the auxiliary conduit 64 can be configured with the vent tube 60 so that air PA is added at about 15 to 30 degrees to create the airflow. The advantage of using a high pressure fan 62 coupled to the auxiliary conduit 64 (i.e., the smaller tube) to create a venturi is that the fan does not interact with the hot gases and air HA from the internal cavity 56 of the drum 52 when making asphalt. In particular, the hot air and gases HA within the drum 52 do not run through the high pressure fan 62. Rather, the fan 62 pulls air that is at an ambient temperature outside the drum 52 and blows it into the vent tube 60 to create a negative pressure differential in the vent tube 60 to pull the hot air and gases HA down within the drum 52 into hot gas suction inlets 65 in the vent tube 60 positioned at the back of the drum 52 and then outward through the vent tube 60. The vent tube 60 can comprise an adjuster such as a damper 66 that can adjust the air flow to optimize the mixer heating performance. In some embodiments, an airflow sensor 66A can be in operable communication with the adjuster 66 and the venture type fan 62 to monitor and automatically adjust the air flow within the mixing drum 52. For example the airflow sensor 66A, the adjuster 66 and the venture type fan 62 can be in communication with a control panel as described above. To install the vent tube 60 in the mixing drum 52, the vent tube 60 can have a ceramic or other high temperature bearing 68 that can connect to a portion of a drum drive 59 that extends into the internal cavity 56 of the mixing drum 52. The ceramic bearing 68 stabilizes the vent tube 60 within the mixing drum 52 without rotating with mixing drum 52.

The vent tube 60 solves a problem that can occur in a large mobile mixing device 50 with a long mixing chamber 54. The heat flow within such large mobile mixing devices 50 from the mouth 58 to the far end of the mixing drum 52 is poor as it is with mobile mixing device 50 which have only one end open, such as most cement mixers. The venturi type fan 62 and auxiliary conduit 64 can thereby be configured with the vent tube 60 to draw hot gases through the mixing chamber formed by the internal cavity 54 in order to achieve even heating across the mixing chamber and to exhaust the gases from the drum 52. The extreme temperature of the exhaust gases along with discharge particulates will not damage the venturi type fan 60 since the high temperature exhaust gases and particulates are prevented from ever entering the fan 60. An airflow sensor and an adjustor can be in operable communication with the venturi type fan 60 to monitor and automatically adjust the air flow (i.e., the fan speed) in order to attain a specified air flow rate and/or temperature within the mixing drum 52. The airflow sensor and the adjustor can be in communication and/or controlled with a control panel of the mobile mixing device 50.

Figure 9:
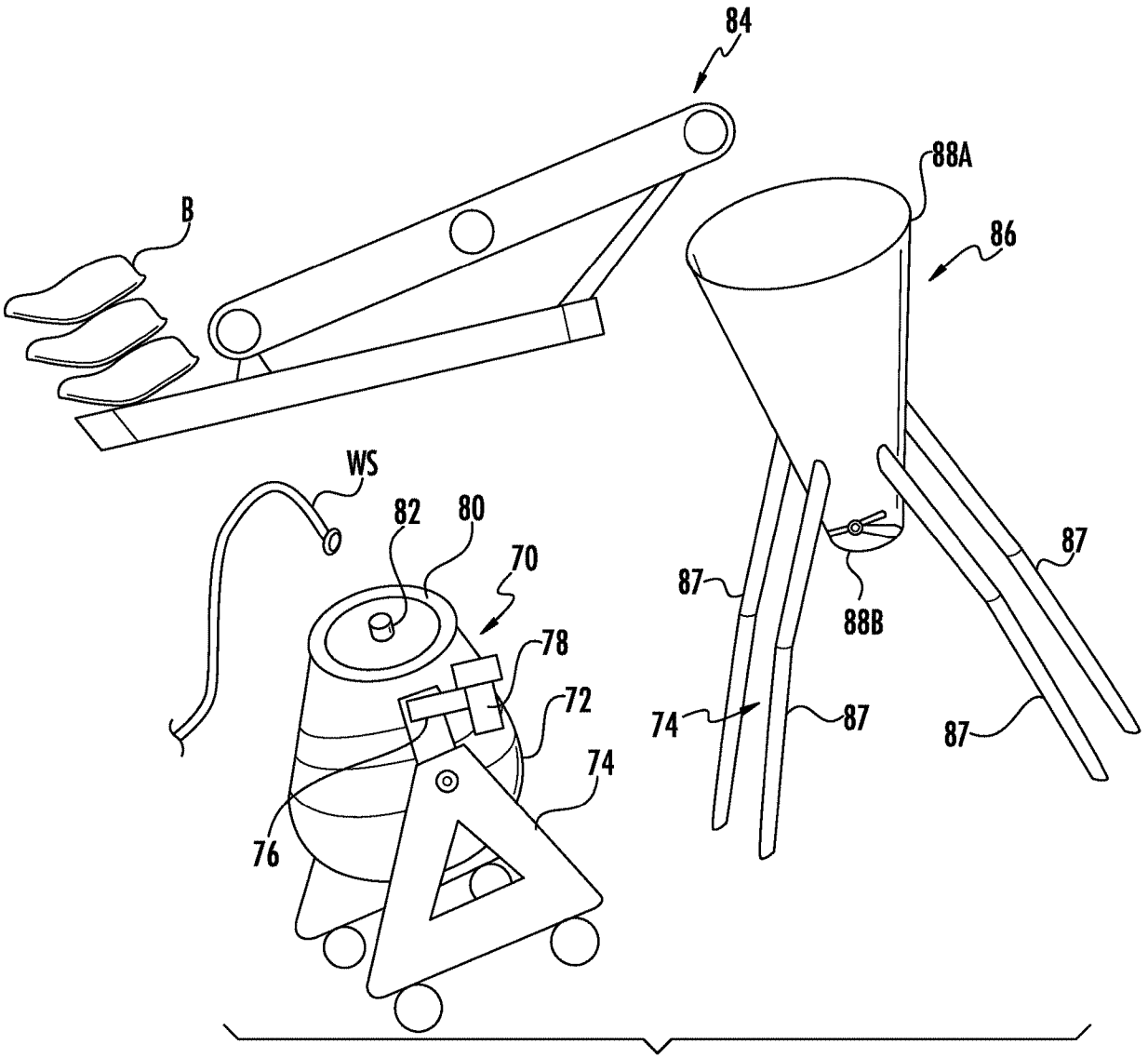
FIG. 9 illustrates a perspective view of an embodiment of the mobile mixing system comprising another embodiment of a mobile mixing device according to the present subject matter.

As shown in FIG. 9, a multiple purpose mobile mixing device 70 can be provided with a mixing drum 72, a frame 74, and a heater support arm 76 that holds a heater 78. The mobile mixing device 70 can also comprise a mixing drum cap 80 that can be used to cover the mixing drum 72. The mixing drum cap 80 can be used to cover the mixing drum 72 when mixing concrete, flowable fill, or other cement-based product that can contain small particle fines (i.e., very small aggregates) and can create dust. The mixing drum cap 80 can keep the contents of the concrete mix in the mixing drum 72. In some embodiments, the mixing drum cap 80 can comprise an inlet 82 therein to allow insertion of a liquid into the mixing drum 72 with the mixing drum cap 80 over the mouth of the mixing drum 72. For example, in some embodiments, a mixing drum cap 80 with a liquid inlet 82 therein can be used to cap the mouth of the mixing drum when flowable fill is loaded in the mixing drum 72 with the heater support arm in a stow-away position. The mixing drum cap 80 can contain the dust generated from the flowable fill during the mixing operation. The mixing drum cap 80 can be added after the flowable fill is loaded in the mixing drum 72 and removed before emptying the flowable fill from the mixing drum 72. The liquid inlet 82 can be used to add the water to the mixing drum 72 from a water supply WS. The liquid inlet 82 can have a threaded extension so that a water supply WS can be threadably attached to the mixing drum cap 80 to supply water into the drum when the mixing drum cap 80 is in place over the mouth. For example, the water supply WS can be a metered water supply so that an exact amount of water can be added based on the amount of flowable fill, concrete or other cement product to be made.

For jobs that require a large amount of mixing, a mobile mixing system can comprise a conveyor 84 and/or a loading bin 86 as shown in FIG. 9 to load raw materials into the mobile mixing device 70. In some embodiments, the conveyor and loading bin can be combined on a single frame. The conveyor 84 and the loading bin 86 as well as the mobile mixing device 70 can be used in a variety of manners and combinations. The conveyor 84 may sit on the truck, trailer or ground and can be configured and positioned to project into the mouth of the mixing drum 72 or the loading bin 86. For example, in some embodiments, the mobile mixer system including the conveyor 84 and/or the loading bin 86 can be loaded on a trailer along with pallets of bags B of raw material. Once the trailer is pulled to the jobsite, the mobile mixer device 70 can be unloaded and the conveyor 84 positioned to feed either the mobile mixing device 70 or the loading bin 86 without much movement from the pallet to the conveyor 84. This eliminates the need for manually lifting the bags B or shoveling materials into the mixing drum 72 and also eliminates the need for the user to reach into the mixing drum 72. Further, in some embodiments, the conveyor 84 can comprise a splitter on its distal end that splits bags B of raw material as the bags B leave the conveyor 84 and enter the mouth of the mixing drum 72.

When using the loading bin 86, the operator can proportion (volumetrically) and dispense the materials into the mixing drum 72 and/or onto a conveyor 84 to feed materials to the mixer. Alternatively, the conveyor 84 can be used to feed material to the loading bin 86 as shown in FIG. 9. The mobile mixing device 70 can be moved under the loading bin 86 can be loaded into the mixing drum 72. The loading bin 86 may sit on the truck, trailer or ground. Materials can be loaded into the loading bin 86 in different manners. For example, materials can be loaded into the loading bin 86 by a bucket attached to a skid-steer or loader. In such a manner, a large size and capacity loading bin 86 can be quickly and easily loaded to speed up the loading process by allowing a large quantity of materials to be loaded into the loading bin 86 with a bucket loader machine and smaller quantities to be discharge from the loading bin 86 to the mobile mixing device 70 by volumetrically proportioning material outflow from the loading bin 86 to the mixing drum 72. In some embodiments, the loading bin can comprise a funnel, or trough, that has a closeable opening at a bottom portion of the funnel, or trough, to permit material placed therein to be metered out. For example, the loading bin 86 comprises extendable legs 87 and a hopper 88 that has a wider opening at a top end 88A and smaller closable opening at a bottom end 88B. The hopper 88 can be configured to funnel material toward the closable opening at the bottom end 88B.

The extendable legs 87 allows the hopper 88 can be held in an upstanding position and the mouth of the mixing drum 72 of the mobile mixing device 70 can be moved under the closeable opening in the bottom end 88B of the hopper 88. In this manner, for large job sites, one or more loading bins 86 can be filled with raw material and then a mobile mixing device 70 can be driven or moved under the hopper 88 and raw material can be metered, out into the mouth of the mixing drum 72.

Figure 10:
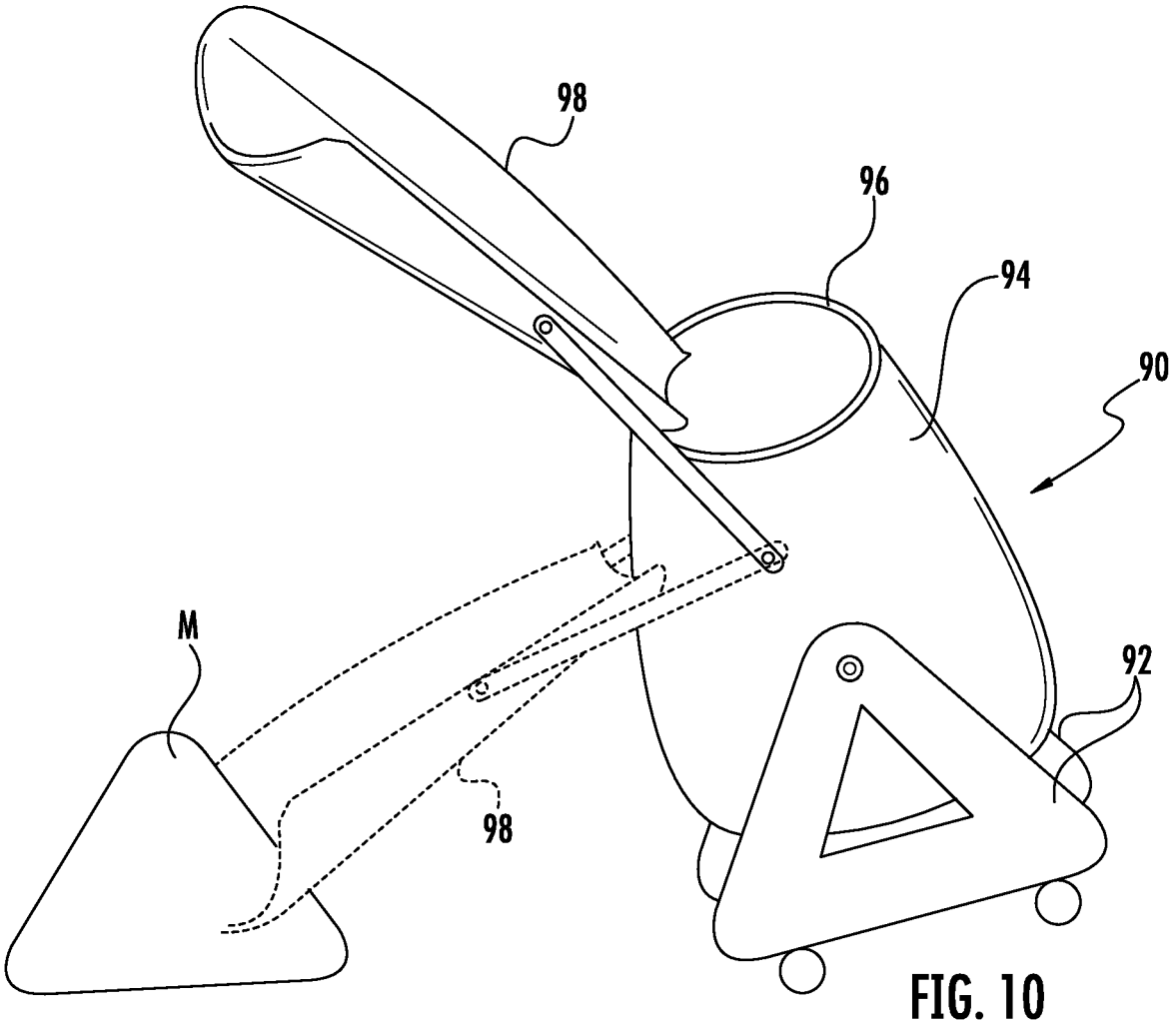
FIG. 10 illustrates a perspective view of another embodiment of a mobile mixing device according to the present subject matter.

In some embodiments as shown in FIG. 10, a mobile mixing device 90 can comprise a frame 92 and a mixing drum 94. The mobile mixing device 90 can comprise a material scoop 98 that can be fitted to the mobile mixing device 90. In particular, the material scoop 98 that can be fitted to the frame 92. As shown in phantom in FIG. 10, the scoop 98 can be used to extend outward and downward from the mixing drum 94 to pick up material in proximity to the mixing drum 94. The scoop 98 with material to be processed thereon can be extended at an angle above a mouth 96 of the mixing drum 94 so that the material on the scoop 98 slides down the scoop 98 and into the interior of the mixing drum 94. Thereby, when the mobile mixing device 90 with a scoop 98 secured thereon is being used, materials can be scooped up and loaded from a material pile, directly into the mouth 96 of the mixing drum 94.

As stated above, the mobile mixing device can have a water supply (water storage tank), a water hookup valve with plumbing and/or a water meter attached so it is combined into one unit. The water can be used as a component of cement or flowable fill used in the mixing drum and/or as a cleaning fluid for rinsing out and cleaning the mixing drum after each use. The cleaning of the drum after each use allows for the multiple purpose mobile mixing device to separately process flowable fill, different types of cements, and different types of asphalts in a single mixing drum. The water can be metered using a water meter that can measure the water supply to, for example, 0.1 gallons or 0.01 gallons. This allows accurate mixing with the correct amount of water when mixing concrete and flowable fill. In some embodiments, a computer with a computer interface or display for the user can be in operable communication with the water meter to allow the flow of water into the mixing drum to be monitored and/or controlled. In some embodiments, the mobile mixing device can comprise a water hookup valve with plumbing to attach a separate water supply, for example, a valve for connecting a hose that is connected to a spigot stationed near the desired location of use of the mobile mixing device. In some embodiments, the mobile mixing device can comprise a water hookup valve with to attach a separate water supply and a water meter secured to the water hookup valve to measure the amount of water being supplied through the valve.

In some embodiments, a water sprayer, water plumbing and pump attached to the mixer and optionally a water tank can be used to clean the mixer after using cement or flowable fill and to add water to the mixer when mixing either flowable fill or cement. If a water supply is readily available for supplying water at the desired location, then the water hookup valve can be detached from the water tank and pump and can be secured to the local water supply as needed. The mobile mixing device can also comprise a heater for use in cold weather. For example, in cold weather, the heater can be on board the mobile mixing device that can be used to heat water within the mixing drum. Since the flowable fill (and cement) set time is temperature sensitive, the heater can adjust the mix temperature to shorten or adjust the reaction time in cold temperatures. For example, the heater can be secured proximal to the water supply or water tank to heat the water before it is inserted into the mixing drum.

The mobile mixing device can comprise a timer configured to be secured to a frame of the mobile mixing device. In embodiments where the mobile mixing device comprises a skid-steer, the timer can be placed within the cab of the skid-steer or at a position closer to the mixing drum itself. The timer can be used to know how long until the product being processed is ready or to give notice to the user when the processing of the product is finished and the product is ready to pour. Such a timer is especially useful when processing flowable fill which sets extremely quickly. Thus the timer can be used to indicate how long until the flowable fill sets and how long until the asphalt reaches the processing temperature and how long until the concrete has set.

The device can also comprise a non-heated or heated liquid material tank. For example, the heated liquid material tank can comprise a heater that can heat material placed in the heated material tank. In some embodiments, for example, a block of a solid binder, or additive, material can be placed in the liquid material tank and heated to a temperature at which the binder or additive material melts. The liquid material tank can also comprise a sprayer and pump that can be fitted to the mixer. The sprayer can be used to spray or distribute the heated binder or additive material to combine heated additives, asphalt and/or water to the cement or flowable fill or asphalt.

The mobile mixing device can also comprise a tilt level indicator to identify to the operator the angle of tilt of the drum of the mobile mixing device at any given time. For example for some embodiments where the mobile mixing device comprises a mixing drum secured to a vehicle, the tilt level indicator can comprise a mechanical indicator on the mixing drum and can be seen from the cab of the vehicle. For example, in some embodiments, where the mobile mixing device comprises a mixing drum secured to arms of a skid-steer, the tilt level indicator can be seen from operator sitting in the cab of the skid-steer. Depending on the tilt of the mixing drum, the operator can adjust the position of the drum to a proper angle based on the specific step the mobile mixing drum is performing. Further, the operator or other external devices can adjust the mixer tilt according to how much material is in the mixer to optimize performance. When mixing the flowable fill, cement, or asphalt, the angle of the drum should be optimized depending on how much material is in the drum to achieve optimum mixer performance.

The mobile mixing device can also comprise a temperature sensor that can be used to monitor and/or record the temperature of the material within the mixer. The temperature sensor can be in communication with a temperature display or a control panel as described above that can have a display. For example, the temperature sensor can be an exterior sensor that measures the temperature within the drum based on temperature readings performed outside the drum. In such embodiments, the temperature display can be configured in a housing with the temperature sensor. In some embodiments, a more accurate temperature reading can be performed by a temperature sensor configured within the interior of the drum. In such embodiments, the temperature sensor can communicate with the temperature display through a wired or wireless connection. In some embodiments where the mobile mixing device comprises a mixing drum secured to a vehicle, the temperature display can reside in or can be seen from the cab of the vehicle. For example, in some embodiments, where the mobile mixing device comprises a mixing drum secured to arms of a skid-steer, the temperature display can reside in the cab of the skid-steer. In some embodiments, the temperature sensor and/or temperature display can comprise or be in communication with a timer to indicate that a set amount of time has elapsed from when the mixer began mixing, from when the heater begun heating, and/or when the temperature reaches a desired temperature. An audible or light emitting alarm can be in communication with the timer and/or temperature sensor to alert the operator that the set amount of time has expired and/or a set temperature has been reached. Further, the audible or light emitting alarm can comprise a portion of the temperature display.

Additionally, the mobile mixing device can comprise a weight load sensor to indicate the weight of material placed in the mixing drum. The weight sensor can provide information that permits a more precise amount of material is mixed to reduce waste and prevent problems associated with making too little product for use in filling potholes or the like. For example, the weight sensor can comprise or be in communication with an indicator gauge (such as a hydraulic pressure or amperage type gauge), a control panel as described above, or another computer processor and a display to inform the operator the amount of material loaded in the mixing drum. The operator can monitor this weight to prevent overproduction or under production of the desired flowable fill, cement, or asphalt product being made. In some embodiments, the weight load sensor and display can provide the weight of the raw material so that the operator can determine if more raw material is needed. In some embodiments, the size of the space to be filled or the amount of finished material can be calculated by the operator using the gauges, a control panel as described above, or another computer processor and display. Those calculations as well as the type of area to be filled and the types of finished material that will fill the area can be used to provide a calculation of the amount of each specific raw material to be used in each stage. The amount of each specific raw material can then be measured as it is placed in the mixing drum by the weight load sensor. Such weight load sensor can be especially useful for a large mobile mixing device such as a converted cement mixer trailer, converted cement mixer truck, or the like.

Pelletized asphalt can be mixed with the appropriate aggregates in the mixing drum to produce a high quality hot mix asphalt that is ideal for rapid repair of military airfields, airport runways, DOT projects and other uses where the mix design of the asphalt may be critical. The multiple purpose mobile mixing device of the skid-steer with a mobile mixing device attachment thereon can also be used for reheating asphalt millings and producing 100% recycled mix that is suitable for roadway, pavement, concrete, parking lot and other construction surface repairs.

To process an asphalt mixture, a desired amount of raw, mixed, or packaged material can be fed into the mouth of the mixing drum. In some embodiments, the mobile mixing device can process up to 400 lbs. of material at a time. In some embodiments, the mobile mixing device can process up to 1,000 lbs. of material at a time, while larger capacity mobile mixing devices will process greater quantities. For example, some embodiments of the mobile mixing device can hold about 2,000 lbs. or more. Material can be loaded into the mixing drum in different manners as described above. For example, the material can be dispensed from loading bins, shoveled or scooped from piles, poured in from buckets, or loaded prepackaged meltable plastic bags. A 50 lb. quantity of mix will cover approximately 1 sq. ft. at 4 inches deep. Once loaded, the operator can level the mixing drum toward horizontal axis as much as possible without losing mix material within the internal cavity of the mixing drum. To discharge a full load, the mixing drum can be tilted on an upward angle.

Once the material is loaded in the mixing drum, the operator can pull on the retractable pin to release the folding heater arm and swing the heater into the heating position with the heater pointing into the mouth of the mixing drum. The mobile mixing device attachment can be designed so that the heater will only ignite when in the heating position with the heater pointing into the mixing drum. The mobile mixing device, can start the rotation of the mixing drum in the clockwise direction as viewed by the operator sitting in the skid steer. When all personnel are clear from the mobile mixing device, the operator can turn the heater to an on position. The operator can make note of the start time or a timer can be started to measure how long the mix material is being heated.

The heater and mixing drum can run for the allotted time to bring the mix to the desired temperature, such as to about 340° F. Heating a full load can require about 15 minutes of heating. Heat time will vary depending upon ambient temperature, moisture content of mix, the BTU capacity of the heater, size of the mixing drum, quantity of material and desired final mix temperature. When finished, the heater can be turned to an off position using a master switch located in the cab of the skid-steer, a control panel in the cab, or an external control panel or by other remote control means. The heater support arm can then be move back to the idle, or stow-away, position. Caution should be used by the operator to make sure not to touch hot surfaces. Once the folding heater arm is locked in the idle, or stow-away, position, the processed hot mix asphalt can be dumped at the desired location. The process can then be repeated.

These and other modifications and variations to the present subject matter may be practiced by those of ordinary skill in the art, without departing from the spirit and scope of the present subject matter, which is more particularly set forth herein above. In addition, it should be understood the aspects of the various embodiments may be interchanged both in whole and in part. Furthermore, those of ordinary skill in the art will appreciate that the foregoing description is by way of example only, and is not intended to limit the present subject matter.

What is claimed is:

1. A multiple purpose mobile mixing device comprising:

a frame comprising hydraulic and electric systems;

a mixing drum securable to the frame, the mixing drum comprising a body that forms an internal cavity and having an open end and a closed end, the mixing drum comprising a mouth at the open end of the body that provides access to the internal cavity of the mixing drum;

a heater support arm comprising electric and hydraulic lines and a heater secured to an end of the heater support arm that is distal from the mixing drum, the heater support arm being movable between a stow-away position such that the heater support arm is off to a side of the mixing drum and a heating position with the heater facing into the mouth of the mixing drum with the heater support arm comprising quick disconnect pins;

quick connects for the hydraulic and electric lines for connection and disconnection of the hydraulic and electrical lines associated with the heater support arm, the quick disconnect pins and the quick connects for the hydraulic and electric lines making the heater support arm easily removable and reattachable; and a mixing drum drive engageable with the mixing drum to rotate the mixing drum; and the mixing drum usable to process either flowable fill or cement in the internal cavity of mixing drum when the heater support arm is in the stow-away position and usable to process asphalt when the heater support arm is in the heating position with the heater facing into the mouth of the mixing drum.

2. The multiple purpose mobile mixing device as in claim 1, wherein the frame comprises a skid-steer.

3. The multiple purpose mobile mixing device as in claim 1, wherein the mixing drum comprises stiffening rings secured to an exterior of the drum to reduce warping of the drum during the mixing and heating of materials.

4. The multiple purpose mobile mixing device as in claim 1, further comprising a vent tube extending from the open end of the mixing drum to a point near the closed end of the mixing drum body, the vent tube exhausting the hot gases and increasing the uniformity of hot air flow along the length of the internal cavity of the mixing drum body.

5. The multiple purpose mobile mixing device as in claim 4, wherein the vent tube further comprises an auxiliary conduit that branches off from the vent tube and a high pressure fan connected to the auxiliary conduit for creating a venturi effect by adding air to the vent tube that pulls a greater amount of airflow in the vent tube below where the air is added.

6. The multiple purpose mobile mixing device as in claim 5, further comprising an airflow sensor and an adjustor in operable communication with the high pressure fan to monitor and automatically adjust the air flow within the mixing drum for optimal uniformity of mix temperature across the length of the mixing drum.

7. The multiple purpose mobile mixing device as in claim 1, wherein the heater support arm is hydraulically activated.

8. A multiple purpose mobile mixing system comprising:

a multiple purpose mobile mixing device comprising:

a frame;

a mixing drum securable to the frame, the mixing drum comprising a body that forms an internal cavity and having an open end and a closed end, the mixing drum comprising a mouth at the open end of the body that provides access to the internal cavity of the mixing drum;

a heater support arm comprising electric and hydraulic lines and a heater secured to an end of the heater support arm that is distal from the mixing drum, the heater support arm being movable between a stow-away position such that the heater support arm is off to a side of the mixing drum and a heating position with the heater facing into the mouth of the mixing drum with the heater support arm comprising quick disconnect pins;

quick connect for the hydraulic and electric lines for connection and disconnection of the hydraulic and electrical lines associated with the heater support arm, the quick disconnect pins and the quick connects for the hydraulic and electric lines making heater support arm easily removable and reattachable; and a mixing drum drive engageable with the mixing drum to rotate the mixing drum; and the mixing drum usable to process either flowable fill or cement in the internal cavity of mixing drum when the heater support arm is in the stow-away position and usable to process asphalt when in the heater support arm is in the heating position with the heater facing into the mouth of the mixing drum; and at least one of the following:

a conveyor transportable with the multiple purpose mixing device, the conveyor positionable to carry material from a staging location to the mouth of the mixing drum upon arriving at a desired jobsite; or a loading bin transportable with the multiple purpose mixing device, the loading bin configured to receive material to be loaded into the mouth of the mixing drum of the multiple purpose mixing device.

9. The multiple purpose mobile mixing system as in claim 8, wherein the mixing drum comprises stiffening rings secured to an exterior of the drum to reduce warping of the drum during the mixing and heating of materials.

10. The multiple purpose mobile mixing system as in claim 8, further comprising a vent tube that is extendable through the open end of the mixing drum to a point near the closed end of the mixing drum body, the vent tube exhausting the hot gases and increasing the uniformity of hot air flow along the length of the internal cavity of the mixing drum body.

11. The multiple purpose mobile mixing system as in claim 10, wherein the vent tube further comprises an auxiliary conduit that branches off from the vent tube and a high pressure fan connected to the auxiliary conduit for creating a venturi effect by adding air to the vent tube that pulls a greater amount of airflow in the vent tube below where the air is added.

12. The multiple purpose mobile mixing system as in claim 10, wherein the multiple purpose mixing device further comprises an airflow sensor and an adjustor in operable communication with the venture type fan to monitor and automatically adjust the air flow within the mixing drum for optimal uniformity of mix temperature across the length of the mixing drum.

* * * * *